US007264057B2

(12) United States Patent
Rytlewski et al.

(10) Patent No.: US 7,264,057 B2
(45) **Date of Patent: *Sep. 4, 2007**

(54) SUBSEA INTERVENTION

(75) Inventors: Gary L. Rytlewski, League City, TX (US); Thomas H. Zimmerman, Houston, TX (US); Peter A. Goode, Houston, TX (US); Ashley C. Kishino, Houston, TX (US); John A. Kerr, Sugar Land, TX (US); Alan Christie, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/709,322

(22) Filed: Apr. 28, 2004

(65) Prior Publication Data

US 2005/0189115 A1 Sep. 1, 2005

Related U.S. Application Data

(63) Continuation of application No. 09/920,896, filed on Aug. 2, 2001, now Pat. No. 6,763,889.

(60) Provisional application No. 60/225,230, filed on Aug. 14, 2000, provisional application No. 60/225,440, filed on Aug. 14, 2000, provisional application No. 60/225,439, filed on Aug. 14, 2000.

(51) Int. Cl.
*E21B 33/038* (2006.01)

(52) U.S. Cl. ..... 166/338; 166/351; 166/360

(58) Field of Classification Search ..... 166/338, 166/339, 340, 341, 343, 345, 349, 351, 360, 166/366, 378

See application file for complete search history.

(56) References Cited

U.S. PATENT DOCUMENTS

| | | | | |
|---|---|---|---|---|
| 3,099,316 | A | 7/1963 | Johnson | |
| 3,633,667 | A | 1/1972 | Falkner | |
| 3,795,114 | A | 3/1974 | DeCrémiers et al. | |
| 4,194,857 | A | 3/1980 | Chateau et al. | |
| 4,602,893 | A * | 7/1986 | Gist et al. | 405/185 |
| 4,673,041 | A | 6/1987 | Turner et al. | |
| 4,702,320 | A * | 10/1987 | Gano et al. | 166/343 |
| 4,784,527 | A * | 11/1988 | Hunter et al. | 405/207 |

(Continued)

FOREIGN PATENT DOCUMENTS

| | | |
|---|---|---|
| GB | 2300439 | 11/1996 |

(Continued)

*Primary Examiner*—Kenneth Thompson
*Assistant Examiner*—Daniel P Stephenson
(74) *Attorney, Agent, or Firm*—Trop, Pruner & Hu, P.C.; Kevin B. McGoff; Bryan P. Galloway

(57) ABSTRACT

A method and system of subsea intervention comprises lowering one or more assemblies of intervention equipment into the sea. Underwater marine units (such as remote operated vehicles or small submarines) may be employed to connect the assemblies to each other and to the subsea wellhead equipment. The subsea wellhead equipment includes a carrier line spool (e.g., coiled tubing spool, wireline spool, slickline spool) and equipment to inject a carrier line from the carrier line spool into the subsea well. The carrier line spool can be located underwater, such as on the sea floor or positioned above the subsea wellhead equipment.

25 Claims, 21 Drawing Sheets

U.S. PATENT DOCUMENTS

| | | | | |
|---|---|---|---|---|
| 4,899,823 | A | 2/1990 | Cobb et al. | |
| 5,657,823 | A * | 8/1997 | Kogure et al. | 166/340 |
| 5,676,209 | A * | 10/1997 | Reynolds | 166/345 |
| 5,778,981 | A | 7/1998 | Head | |
| 5,971,665 | A * | 10/1999 | Hughes | 405/159 |
| 6,125,080 | A * | 9/2000 | Sonnenschein et al. | 367/134 |
| 6,182,763 | B1 | 2/2001 | Ingebrigtsen et al. | |
| 6,182,765 | B1 | 2/2001 | Kilgore | |
| 6,209,634 | B1 * | 4/2001 | Avakov et al. | 166/77.3 |
| 6,276,454 | B1 * | 8/2001 | Fontana et al. | 166/343 |
| 6,386,290 | B1 | 5/2002 | Headworth | |
| 6,457,526 | B1 * | 10/2002 | Dailey | 166/338 |
| 2002/0134552 | A1 * | 9/2002 | Moss | 166/339 |
| 2003/0029618 | A1 * | 2/2003 | Schempf et al. | 166/343 |
| 2003/0106714 | A1 * | 6/2003 | Smith et al. | 175/6 |

FOREIGN PATENT DOCUMENTS

| | | |
|---|---|---|
| GB | 2307288 | 5/1997 |
| GB | 2385872 | 9/2003 |
| WO | WO83/02798 | 8/1983 |
| WO | WO88/03596 | 5/1988 |
| WO | WO99/05388 | 2/1999 |
| WO | 1999063196 A1 | 12/1999 |
| WO | WO 01/61145 | 8/2001 |

* cited by examiner

SUBSEA INTERVENTION

CROSS REFERENCE TO RELATED APPLICATIONS

This is a continuation of U.S. Ser. No. 09/920,896, filed Aug. 2, 2001, now U.S Pat. No. 6,763,889 which claims the benefit under 35 U.S.C. §119(e) of U.S. Provisional Application Ser. Nos. 60/225,230, filed Aug. 14, 2000; 60/225,440, filed Aug. 14, 2000; and 60/225,439, filed Aug. 14, 2000.

BACKGROUND OF INVENTION

The invention relates to subsea well intervention.

Subsea wells are typically completed in generally the same manner as conventional land wells and are subject to similar service requirements as land wells. Further, as with land wells, services performed by intervention can often increase the production from the subsea well. However, intervention into a subsea well to perform the desired services is typically more difficult than for land wells. Conventionally, to perform subsea intervention, the operator must deploy a rig (such as a semi-submersible rig) or a vessel, as well as a marine riser, which is a large tubing that extends from the rig or vessel to the subsea wellhead equipment.

Interventions may be performed for various reasons. For example, an operator may observe a drop in production or some other problem in the well. In response, the operator performs an intervention operation, which may involve running a monitoring tool into the subsea well to identify the problem. Depending on the type of problem encountered, the intervention can further include shutting in one or more zones, pumping a well treatment into a well, lowering tools to actuate downhole devices (e.g., valves), and so forth.

Although intelligent completions may facilitate the determination of whether to perform intervention, they do not offer a complete range of desired intervention solutions. In addition, not all wells are equipped with the technology.

Performing intervention operations with large vessels and heavy equipment such as marine riser equipment, as conventionally done, is typically time consuming, labor intensive, and expensive. Therefore, a need continues to exist for less costly and more convenient intervention solutions for subsea wells.

SUMMARY OF INVENTION

In general, according to one embodiment, an apparatus for use with a subsea well comprises subsea wellhead equipment and a carrier line spool having a carrier line and that is positioned underwater. An underwater marine unit is adapted to attach the carrier line to the subsea wellhead equipment.

Other features and embodiments will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down" "upper" and "lower" "upwardly" and "downwardly" "below" and "above" and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
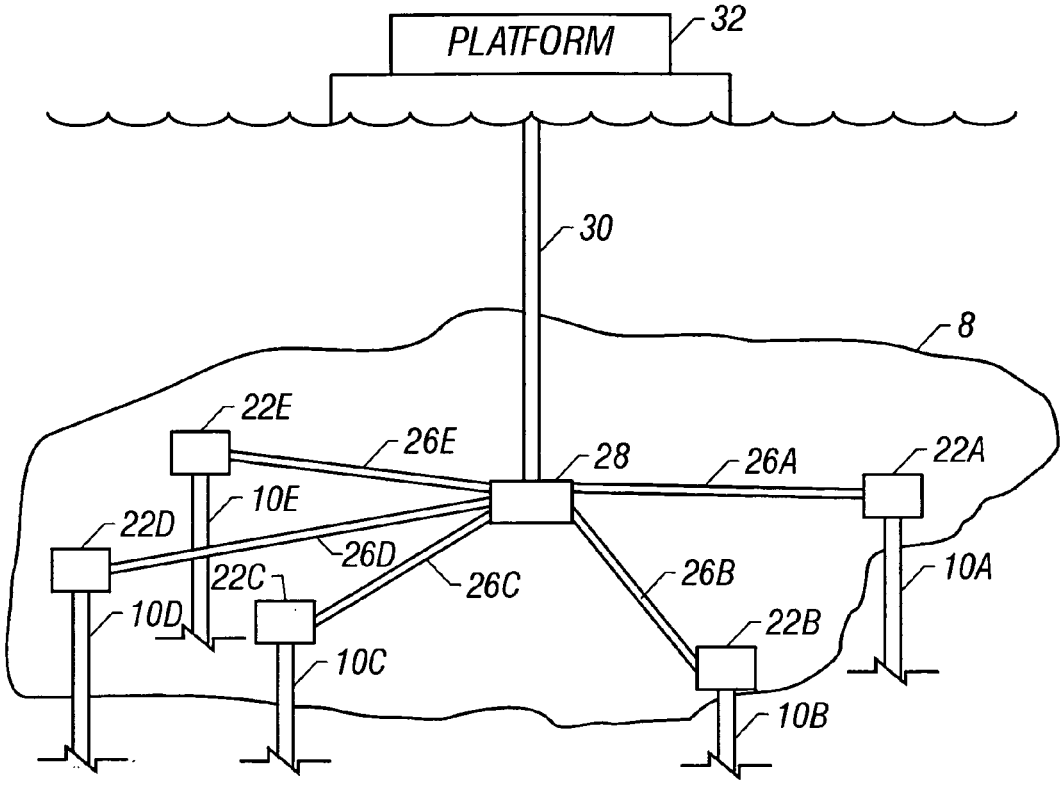
FIG. 1 illustrates an embodiment of a subsea well system having plural wells.
Figure 2:
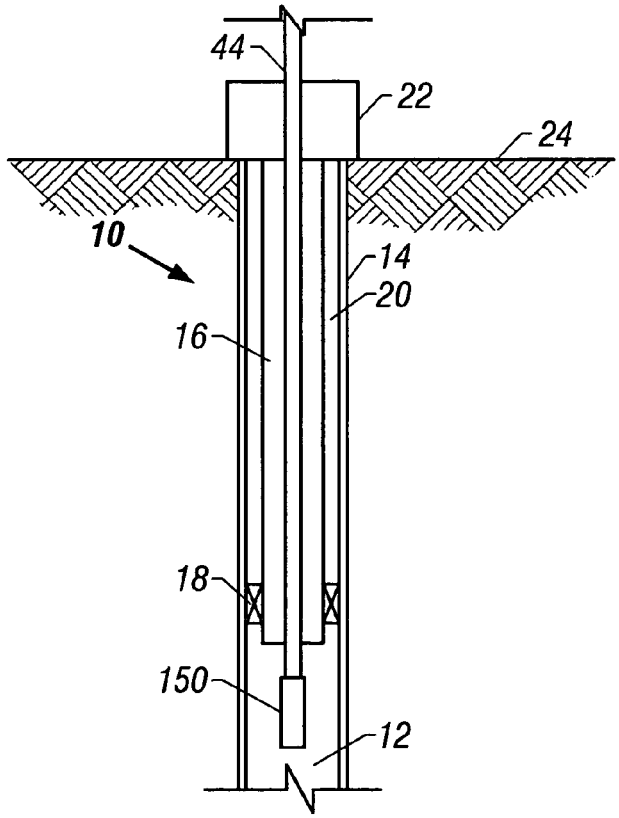
FIG. 2 illustrates a completed well in the subsea well system of FIG. 1.

Referring to FIG. 1, in one example, a subsea field 8 includes a plurality of wells 10 (10A, 10B, 10C, 10D and 10E illustrated). Each well 10 includes a wellbore 12 (FIG. 2) that is lined with a casing or liner 14. A tubing 16, such as a production tubing, may be positioned in the wellbore 12. A packer 18 isolates an annulus region 20 between the tubing 16 and the casing 14 from the rest of the wellbore. Subsea wellhead equipment 22 is located at the well surface, which is the sea floor 24.

As further shown in FIG. 1, the wellhead equipment 22 can be connected to conduits 26 (e.g., hydraulic control lines, electrical control lines, production pipes, etc.) that are run to a subsea manifold assembly 28. Conduits 26A, 26B, 26C, 26D, and 26E connect respective wellhead equipment 22A, 22B, 22C, 22D and 22E to the manifold 28. In turn, various conduits 30 are run to a host platform 32 (which can be located at the sea surface, or alternatively, on land). For example, the platform 32 can be one of many floating facilities, or the platform 32 can be a land-based site. The platform 32 collects production fluids and sends appropriate control (electrical or hydraulic) signals or actuating pressures to the wells 10A-10E to perform various operations. During normal operation, well fluids are delivered through the tubing 16 of each well and the conduits 26, manifold 28, and conduits 30 to the platform 32.

However, over the life of the wells 10, production drops or other anomalies may be encountered. Typically, sensors may be installed in each wellbore 12 to monitor various well attributes, such as well pressure and temperature and production flow rate. Also, formation characteristics can be monitored to determine the productivity of the formation. If a drop in production or some other anomaly is detected in the wellbore 12, an intervention operation may be needed.

With a subsea well, performing an intervention operation using conventional techniques can be expensive. Typically, a large sea vessel or a rig may have to be transported out to the well site. The large sea vessel is needed to haul heavy equipment required to perform the intervention. For example, one such piece of heavy equipment is a marine riser (a relatively large diameter metal tubing) that runs from the sea vessel to the subsea wellhead equipment 22.

In accordance with some embodiments of the invention, to provide for more convenient and efficient intervention of subsea wells, remote operated vehicles (ROVs), autonomous underwater vehicles (AUVs), small submarines, or other underwater marine units are used to carry some of the intervention equipment to a location proximal the subsea wellhead 22. The underwater marine units are also capable of connecting or attaching the intervention equipment to the subsea wellhead equipment. By using embodiments of the invention, certain heavy components (e.g., marine risers) that are conventionally used for intervention operations may be omitted so that smaller sea vessels may be employed.

Figure 3:
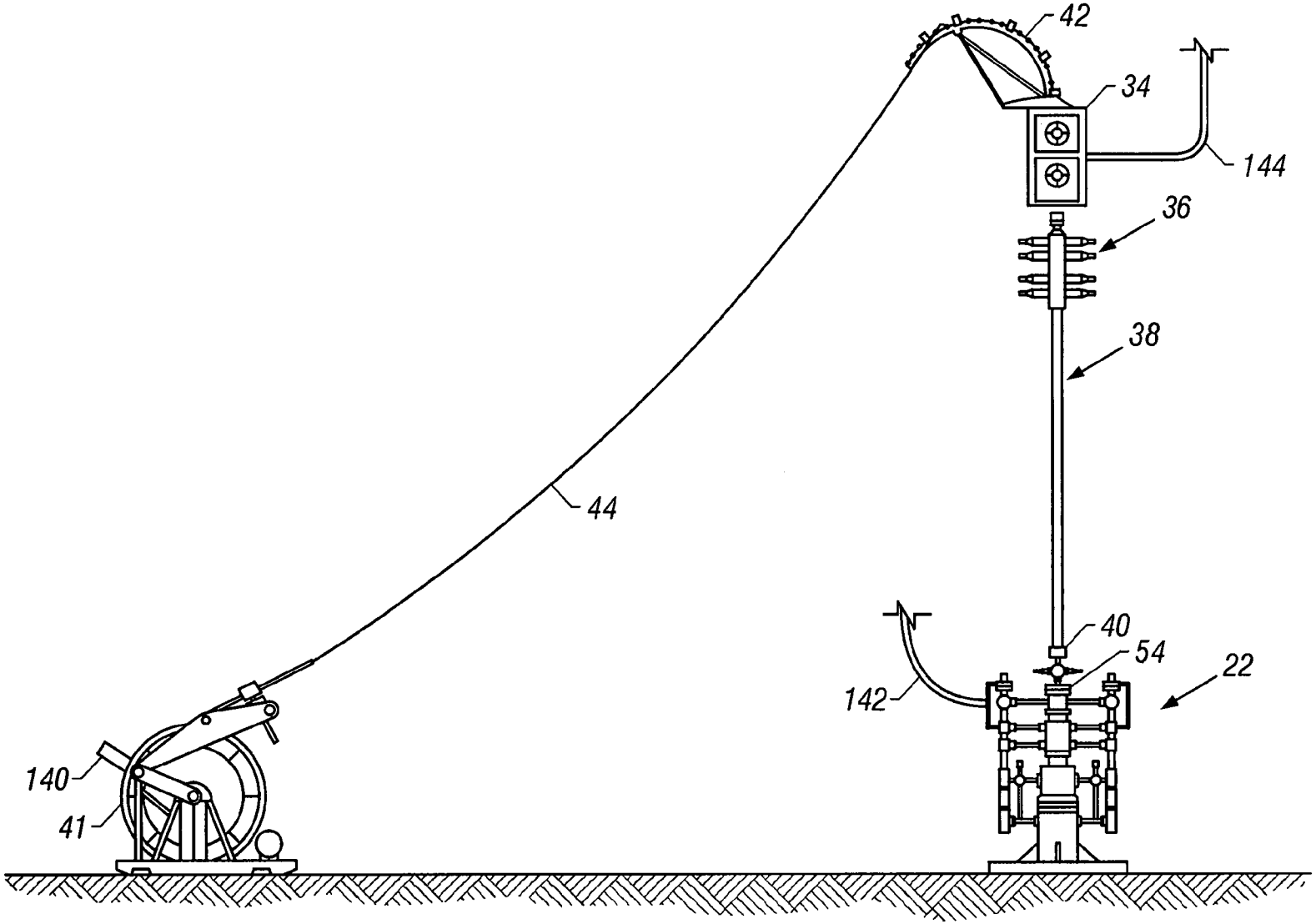
FIG. 3 illustrates an intervention assembly according to one embodiment connected to subsea wellhead equipment.
Figure 7:
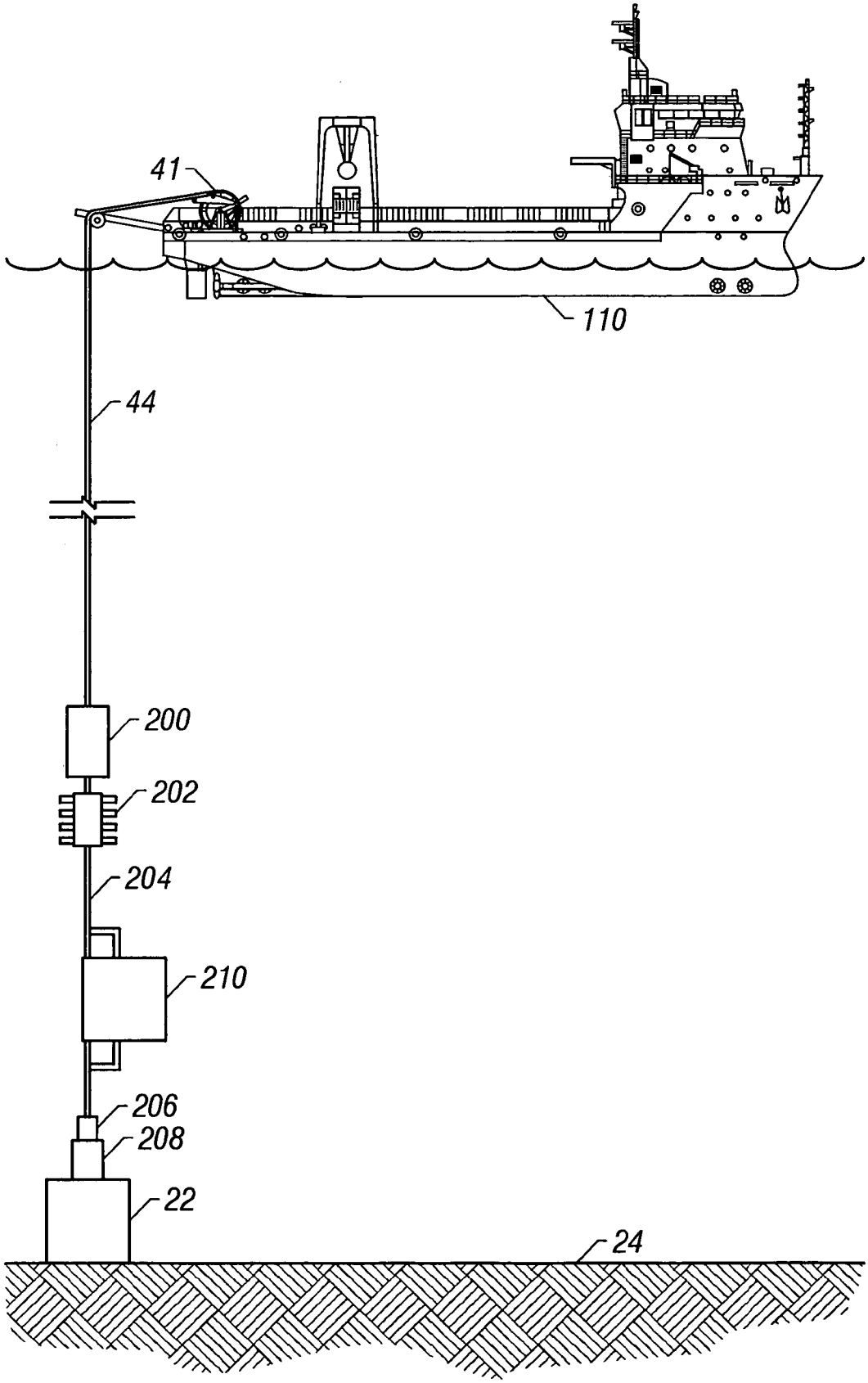
FIG. 7 illustrates an intervention assembly according to another embodiment connected to subsea wellhead equipment.

As shown in FIG. 3, in one embodiment, the intervention equipment includes a carrier line spool 41 on which a carrier line 44 may be loaded. Examples of carrier lines include coiled tubing, wirelines, slicklines, and so forth. The carrier line spool 41 can be positioned on the sea floor 24 (as illustrated in FIG. 3), or alternatively, the carrier line spool 41 can be carried on a sea vessel (as illustrated in FIG. 7). In yet another embodiment, the carrier line spool 41 is part of a well intervention string that is attached to the subsea wellhead (shown in FIG. 9). The intervention method and apparatus according to some embodiments allows the carrier line 44 to enter the well with various barriers (in the form of sealing rams, as discussed below) in place to seal wellhead pressure from the sea. Also, the barriers enable a sea vessel to leave the well site at any time (such as due to emergency or mechanical problems) while the seal is maintained by the wellhead equipment.

In the embodiment of FIG. 3, the intervention equipment further includes a gooseneck 42 to support and guide the carrier line 44. The gooseneck 42 is attached to an injector head 34 that forces the carrier line into or out of the wellbore 12. The injector head 34 includes a drive mechanism (e.g., a chain-type drive mechanism) that is capable of gripping the carrier line 44. The drive mechanism is powered by a hydraulic or electrical motor to drive the chains of the drive mechanism. To protect the components of the injector head 34, the injector head 34 can be placed in a protective chamber (not shown) that is filled with a fluid compensated for seawater pressure, or by way of a one atmosphere can. To keep seawater out of this chamber, strippers may be placed above and below the chamber where the carrier line 44 enters and exits, respectively.

The intervention equipment also includes a blow-out preventer (BOP) 36 having rams for sealing around the carrier line 44 to prevent the escape of well fluids. If wireline or slickline is employed, other types of rams may be used. A lower riser 38 (which is basically a pipe or tubing) is connected below the BOP 36. In another embodiment, the lower riser 38 can be omitted.

Attached to the lower end of the riser 38 is an emergency disconnect package 40 that is releasably connected to a lower riser package 54. The lower riser package 54 is connected to the tree structure of the subsea wellhead equipment 22. Lower riser packages 54 and emergency disconnect packages 40 may be readily available from various manufacturers. Typically, the lower riser package 54 includes a connector to attach to the tree structure of the subsea wellhead equipment as well as an upper profile to connect to the emergency disconnect package. The lower riser package 54 can also include rams that are capable of sealing on or cutting coiled tubing or other types of carrier lines. More generally, a connector assembly is used to connect the injector head 34 to the subsea wellhead equipment. In the illustrated embodiment, the connector assembly includes the riser 38, emergency disconnect package 40, and a lower riser package 54. In other embodiments, other types of connector assemblies can be used.

Figure 4:
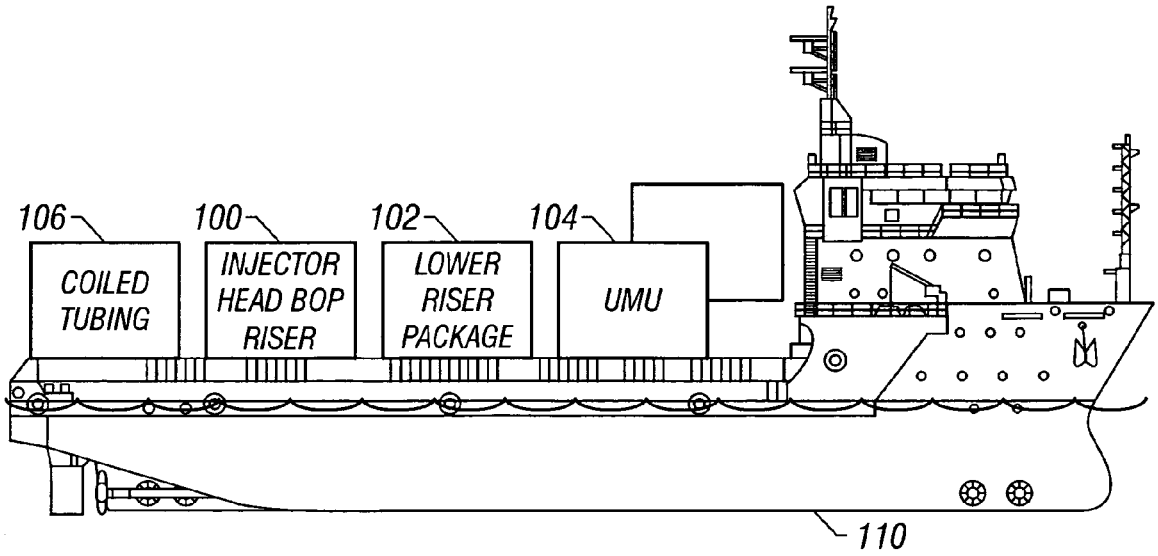
FIG. 4 illustrates a sea vessel used for transporting intervention equipment assemblies in accordance with an embodiment.
Figure 5:
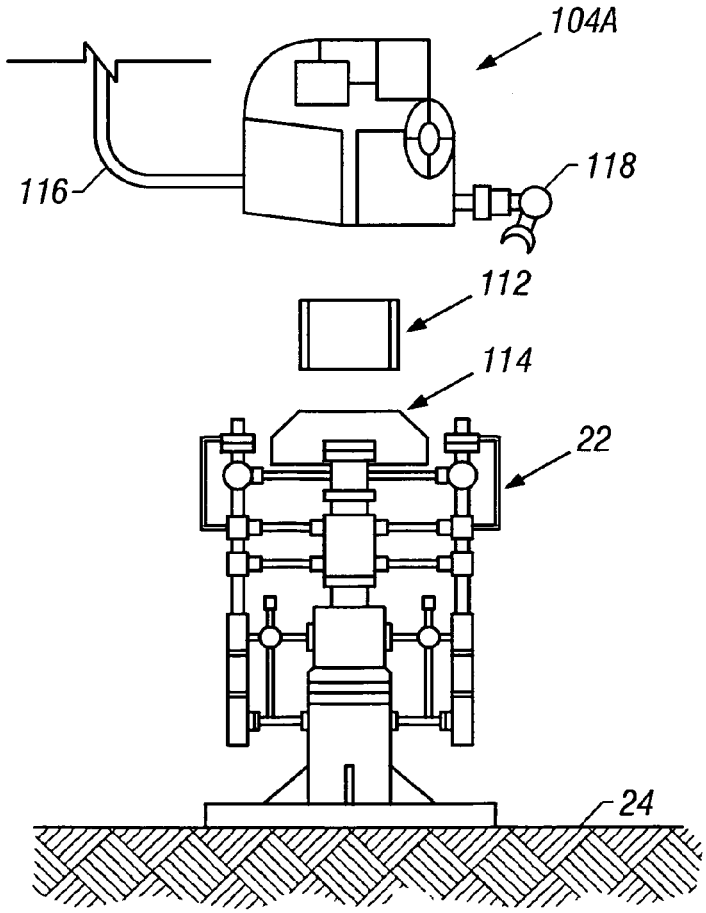
FIG. 5 illustrates removing a tree cap from the subsea wellhead equipment, in accordance with an embodiment.
Figure 6:
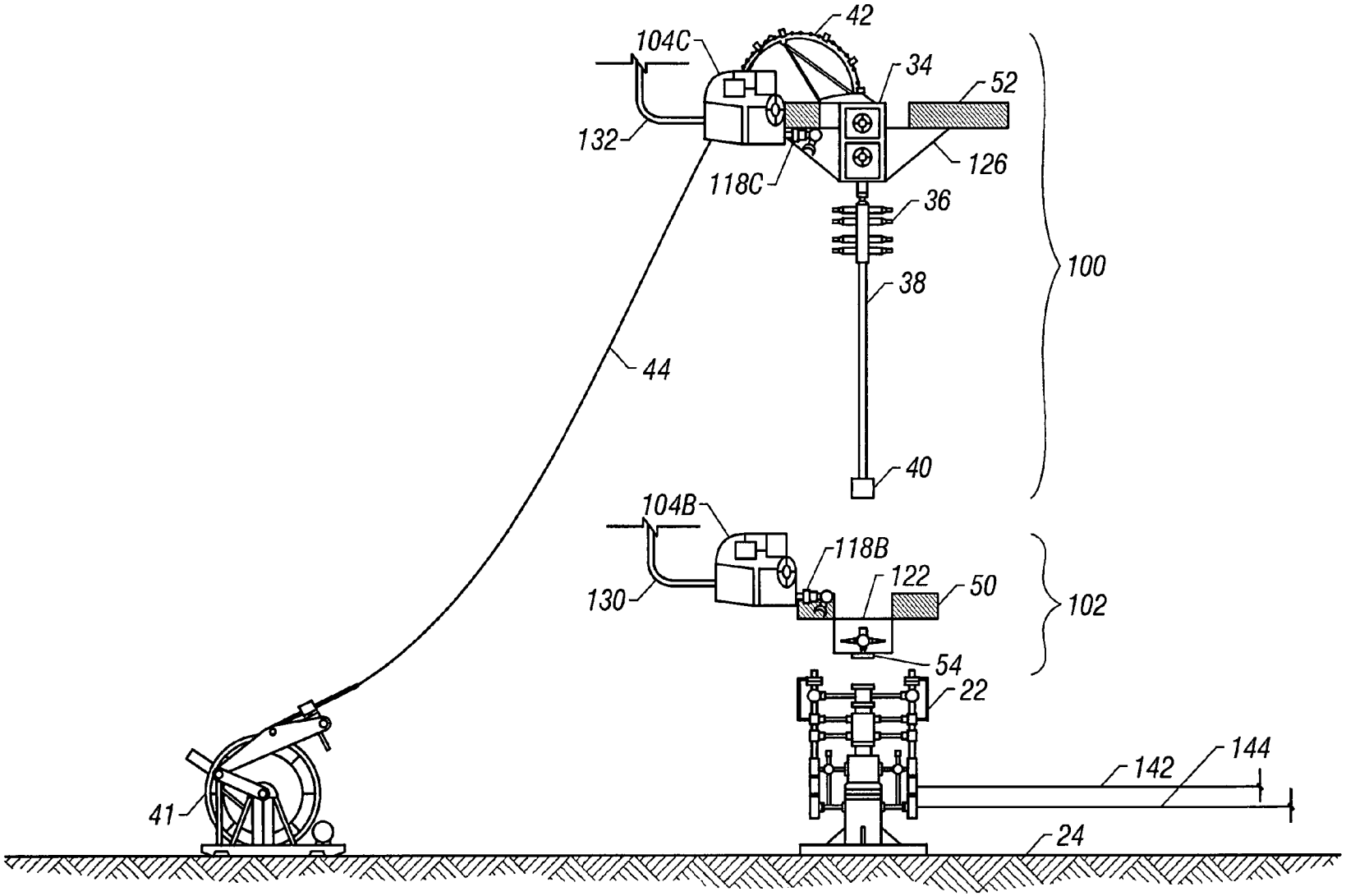
FIG. 6 illustrates assembling an intervention assembly to the subsea wellhead equipment, in accordance with an embodiment.

Referring to FIGS. 4-6, a method and apparatus of transporting intervention equipment according to the embodiment of FIG. 3 to the subsea well site and connecting the intervention equipment to the subsea wellhead equipment is illustrated. In FIG. 4, a sea vessel 110 is used to transport a carrier line (e.g., coiled tubing) spool assembly 106, an injector head/BOP/riser assembly 100, a lower riser package assembly 102, and one or more underwater marine units 104 to the well site. In addition to the respective intervention equipment tools, each of the assemblies 100, 102, and 106 includes buoyancy tanks to aid the lowering of tools into the sea by the underwater marine units 104. Once the sea vessel is located generally over the well in which intervention is to be performed, the underwater marine units 104 are used to carry the various assemblies proximal the subsea wellhead equipment 22.

As shown in FIG. 5, a first underwater marine unit 104A carries a tree cap removal tool 112 to the subsea wellhead equipment 22. The upper end of the wellhead equipment 22 has a tree cap 114 attached to cover the inner components of the subsea wellhead equipment. To enable the attachment of the intervention equipment to the wellhead equipment, the tree cap 114 is first removed. In accordance with some embodiments of the invention, this is accomplished by using a tree cap removal tool 112 carried by the underwater marine unit 104A.

The underwater marine unit 104A is attached to an umbilical line 116, which is used to deliver control signals to the underwater marine unit 104A. The umbilical line 116 includes electrical wires to deliver power and signals to navigate the underwater marine unit 104A. Optionally, the umbilical line 116 may also contain hydraulic conduits to provide hydraulic power and control. In one embodiment, the umbilical line 116 extends from the sea vessel 110 (FIG. 4). Alternatively, the umbilical line 116 extends from the platform 32 (FIG. 1), which can be a platform at the sea surface or on land.

The underwater marine unit 104A includes an arm 118 that is used to carry the tree cap removal tool 112. The tree cap removal tool 112 is carried from the sea vessel 110 to the subsea wellhead equipment. Alternatively, the tree cap removal tool 112 may already be stored in an underwater storage station, such as one described in copending U.S. patent application Ser. No. 09/921,026, entitled "Subsea Intervention System," to Thomas H. Zimmerman et al., filed on Aug. 2, 2001, which is hereby incorporated by reference. Also, as further described in the incorporated reference, the underwater marine unit 104A may be operated without the umbilical line 116. Instead, an alternative guidance system is employed. The alternative guidance includes the underwater marine unit 104A guiding itself between underwater points based on laser lights or underwater tracks. A point can be the underwater storage station and another point can be the subsea wellhead equipment. Alternatively, the underwater marine unit 104A is controlled using acoustic wave signals or long wavelength optical signals (e.g., blue-green laser) communicated through water.

The underwater marine unit 104A carries the tree cap removal tool 112 to the tree cap 114, with the arm 118 moving the tree cap removal tool 112 to a position to engage the tree cap 114. The tree cap removal tool 112 causes disconnection of the tree cap 114 from the subsea wellhead equipment 22. The tree cap removal tool 112 is used to bleed off any pressure below the cap 114. Alternatively, bleeding off pressure can be accomplished via an umbilical line (not shown) from the subsea wellhead equipment below the cap 114. The cap retrieval tool 112 is equipped with a jacking capability for dislodging the cap 114 from the tree of the subsea wellhead equipment 22. Once the tree cap 114 is removed, attachment of intervention equipment to the subsea wellhead equipment 22 can proceed.

In an alternative embodiment, instead of a tree cap, the subsea wellhead equipment can include a valve to perform fluid control. The valve is normally closed, but can be opened if attachment of intervention equipment to the subsea wellhead equipment is desired. To provide full bore access for intervention tools, the valve can be a ball valve.

In FIG. 6, the various intervention equipment components according to the embodiment of FIG. 3 are lowered into the sea to the proximity of the subsea wellhead equipment 22. As shown in FIG. 6, the carrier line spool 41 has already been run to the sea floor 24 by an underwater marine unit 104. The carrier line spool 41 is part of the carrier line spool assembly 106 carried on the sea vessel 112 (FIG. 4). Due to the possibly heavyweight of the carrier line spool 41, buoyancy tanks (not shown) that are part of the carrier line spool assembly 106 are attached to the carrier line spool 41 for lowering from the sea vessel 110 by an underwater marine unit 104. Alternatively, the carrier line spool 41 may already have been left at the sea floor 24 proximal the subsea wellhead equipment 22 as part of the well completion procedure.

The other assemblies 100 and 102 similarly include buoyancy tanks. As shown in FIG. 6, the lower riser package assembly 102 includes the lower riser package 54 and buoyancy tanks 50 attached by a frame 122 to the lower riser package 54. The injector head/BOP/riser assembly 100 includes buoyancy tanks 52 connected by a frame 126 to the assembly. The assembly 100 includes the gooseneck 42, injector head 34, BOP 36, lower riser 38, and emergency disconnect package 40. Since the assembly 100 is larger and heavier than the assembly 102, larger buoyancy tanks 52 may be used.

The lower riser package assembly 102 is carried into the sea by an underwater marine unit 104B (having an arm 118B), and the injector head/BOP/riser assembly 100 is carried by an underwater marine unit 104C (having an arm 118C). The underwater marine units 104B, 104C are connected by respective umbilical lines 130, 132 to the sea vessel 110 (or alternatively, to the platform 32 of FIG. 1). In an alternative embodiment, instead of using multiple underwater marine units 104B, 104C, a single underwater marine unit can be used to carry the assemblies 100 and 102 into the sea in separate runs.

Under control of signals communicated over the umbilical lines 130, 132, or other signaling mechanisms (wired or wireless), the underwater marine units 104B, 104C attach the lower riser package 54 to the subsea wellhead equipment 22. After the lower riser package 54 has been attached, the buoyancy tanks 50 are detached from the lower riser package 54 and carried away by the underwater marine unit 104B.

Next, the underwater marine unit 104C connects the emergency disconnect package 40 (at the lower end of the assembly 100) attached at the lower end of the riser 38 to the lower riser package 54. After connection, the buoyancy tanks 52 are detached from the assembly 100 and carried away by the underwater marine unit 104C.

The underwater marine units 104B and 104C (as well as the unit 104A) can be driven back to the sea vessel 110 (or the platform 32). Alternatively, the underwater marine units 104 can be kept in close proximity to the subsea wellhead equipment 22 that is subject to intervention in case some further manipulation of the intervention equipment is needed. Although plural underwater marine units 104A, 104B, and 104C are described, a smaller (or greater) number of underwater marine units may be employed in further embodiments.

In an alternative embodiment, the gooseneck 42, injector head 34, BOP 36, riser 38, emergency disconnect package 40, and lower riser package 54 can be lowered as a single assembly (instead of separate assemblies). This reduces the number of attachment operations needed to be performed underwater by the underwater marine units 104.

To address various handling issues, the intervention equipment (or modules of the intervention equipment) may be assembled at a shallow depth near the sea vessel 110. After assembly in the shallow depth, the assembly can be tested before lowering to the sea floor. During assembly, buoyancy tanks may be connected to the riser 38 to place it in tension to reduce bending stresses on the riser 38 and stresses on connections.

Umbilical lines 142 and 144 for intervention control and pumping operations may be lowered from the sea vessel 110 for connection to the subsea wellhead equipment 22 and the injector head 34. As further shown in FIG. 3, if the carrier line spool 41 is a coiled tubing spool, then a coiled tubing flow control line (not shown) can be run from the sea vessel 110 for connection to a connector 140 of the spool 41. Instead of being run from the sea vessel 110, the umbilical lines and coiled tubing flow line can be run from the host platform 32 (FIG. 1). The latter approach reduces the amount of hydraulic and pumping equipment needed on the sea vessel 110. In yet another approach, a manifold (such as manifold 28 in FIG. 1) provided on the sea floor 24 can be used to connect to the umbilical lines and coiled tubing flow line. The coiled tubing flow line connects a source of fluid to the subsea wellhead equipment 22. Alternatively, if the spool 41 is a wireline spool, then an electrical cable can be run from the sea vessel 110 or other source to connect to the spool 41.

To provide structural rigidity to each intervention equipment assembly (100 or 102), a frame or other structure (not shown) may be connected around the assembly. The frame provides stiffness to the assembly to protect components from undue bending stresses. The frame can also carry built-in buoyancy tanks. Further, the frame may include a self-propulsion mechanism to help an underwater marine unit 104 transport the assembly to a desired underwater location. The frame may also be used as a platform that can be towed behind the sea vessel 110. The intervention equipment can be kept on the frame and not loaded onto the sea vessel 110.

After connection of the intervention equipment to the wellhead equipment 22, the assembly illustrated in FIG. 3 is provided. As further shown in FIG. 2, the carrier line 44 deployed by some embodiments of the invention through subsea wellhead equipment 22 is connected to an intervention tool 150. As examples, the intervention tool 150 may be a mechanical, hydraulic, or electrical actuator used for operating various downhole devices (e.g., valves). Alternatively, the intervention tool 150 includes sensors or monitors used for collecting measurements regarding various well attributes (e.g., temperature, pressure, etc.).

In one embodiment, to switch intervention tools, the carrier line 44 is raised into the riser 38. The emergency disconnect package 40 is then unlatched from the lower riser package 54, with the equipment above the emergency disconnect package 40 raised to the surface (the sea vessel 110) or to a point in the sea high enough for underwater marine units 104 or divers to switch out tools. Once raised to such a point, the carrier line 44 is lowered out of the riser 38 so that switching of the intervention tool can be performed (in which the present tool is disconnected from and a new tool is attached to the carrier line 44).

In addition to various intervention operations, the equipment discussed above may also be used to carry a drilling string into a well to perform subsea drilling operations. Further, installment of spooled tubing, spooled completions, and spooled velocity strings into a well can be performed.

Referring to FIG. 7, in an alternative embodiment, the carrier line spool 41 is located on the sea vessel 110 instead of the sea floor 24. In this alternative arrangement, one or more assemblies containing an injector head 200, BOP 202, riser 204, emergency disconnect package 206, and lower riser package 208 are lowered into the sea for assembly and connection to the subsea wellhead equipment 22. Since the carrier line spool 41 is located on the vessel 110 (above the injector head 200), a gooseneck may not be needed. In yet another arrangement, the injector head 200 can be located on the sea vessel 110 instead of in the sea to further reduce the number of components that need be lowered to the subsea wellhead equipment 22.

If a vertical run of the carrier line 44 from the sea vessel 110 to the subsea wellhead equipment 22 is desired, then the sea vessel 110 may need a dynamic positioning system to maintain the sea vessel 110 substantially over the wellhead equipment 22. Alternatively, spooling of the carrier line 44 at a non-vertical angle from the sea vessel 110 may be possible, so that dynamic positioning of the sea vessel 110 is not necessary.

Figure 8:
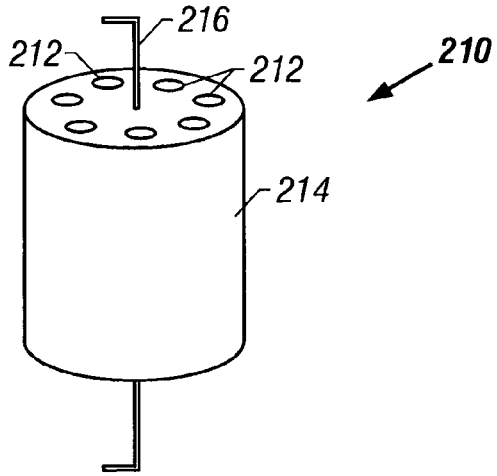
FIG. 8 illustrates a carousel system for use with the intervention assembly of FIG. 7.

To further enhance convenience, a carousel system 210 according to one embodiment can be used to enable easy exchanging of intervention tools attached to the carrier line 44 without retrieving the carrier line 44 all the way back to the sea vessel 110. As further shown in FIG. 8, the carousel system 210 has a rotatable structure 214 with a number of chambers 212 each containing a respective intervention tool. The rotatable structure 214 is rotatable about an axis 216. Thus, depending on the desired type of intervention tool, the rotatable structure 214 is rotated so that the appropriate chamber 212 is aligned with the riser 204. The carrier line 44 is then lowered into the chamber for engagement with the tool in the chamber 212.

In operation with the embodiment of FIG. 7, the injector head 200, BOP 202, riser 204, a carousel system 210, emergency disconnect package 206, and lower riser package 208 are lowered and attached to the subsea wellhead equipment 22. The carousel system 210 is actuated so that the appropriate one of the chambers 212 is aligned with the riser 204. The carrier line 44 is then lowered into the chamber 212, where the carrier line 44 engages the tool. Further downward movement of the carrier line 44 causes the tool to be run into the wellbore.

After the first intervention operation has been completed, the carrier line 44 is raised. The intervention tool connected at the end of the carrier line 44 is raised into the corresponding chamber 218 of the carousel system 210, where the intervention tool is unlatched from the carrier line 44. The carrier line 44 is raised out of the carousel system 210, following which the carousel system 210 is actuated and the rotatable structure 214 rotated so that another chamber 212 containing another type of intervention tool is aligned with the riser 204. The carrier line 44 is again lowered into chamber 212, where it engages the next intervention tool. Another intervention operation is then performed. This process can be repeated until all desired intervention operations possible with tools contained in the carousel system 210 have been performed.

In a further embodiment, the carousel system 210 can also be used with the intervention equipment arrangement shown in FIG. 3.

Figure 9:
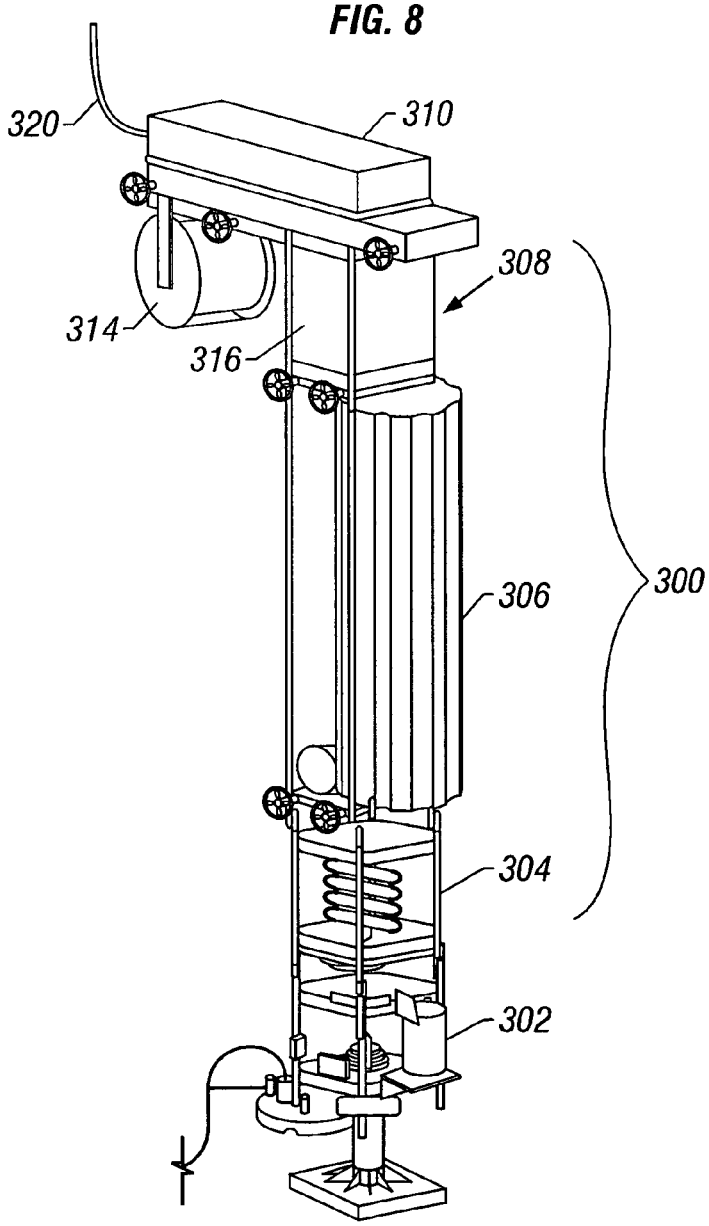
FIG. 9 illustrates another embodiment of an intervention assembly that is connected to subsea wellhead equipment.

Referring to FIG. 9, an intervention assembly 300 in accordance with another embodiment is illustrated. The intervention assembly 300 includes a BOP 304 that is connected to subsea wellhead equipment 302. Connected above the BOP 304 is a carousel system 306, in which a number of intervention tools for selective attachment to a carrier line loaded on a carrier line spool assembly 308. The spool assembly 308 includes a spool 314 on which the carrier line is mounted. The spool assembly 308 also includes an injector head 316 that is attached above the carousel system 306.

As shown, an underwater marine unit 310 is attached to the spool assembly 308. The underwater marine unit 310 is attached by an umbilical line 320 to another entity, such as a sea surface platform, sea vessel, or some other unit (whether located at the sea surface, on land, or on the sea bottom). In one arrangement, the underwater marine unit 310 is capable of controlling actuation of the spool assembly 308 in response to commands communicated over the umbilical line 320. Alternatively, instead of an umbilical line 320, the underwater marine unit 310 is responsive to a wireless form of signaling, such as acoustic wave signaling.

Thus, in the embodiment shown in FIG. 9, the carrier line spool assembly 308 is attached to the string making up the intervention assembly 300. This is in contrast to the intervention assembly of FIG. 3 or FIG. 7, where the carrier line spool assembly is separate from the intervention tool assembly (with the carrier line spool assembly located either at the sea bottom as shown in FIG. 3, or on a sea vessel, as shown in FIG. 7). One advantage offered by the embodiment of FIG. 9 is that the entire assembly 300 can be carried by the underwater marine unit 310 to the subsea wellhead equipment 302 as a unit, thereby avoiding multiple runs with underwater marine units to the subsea wellhead equipment, which can take up a lot of time.

Figure 10:
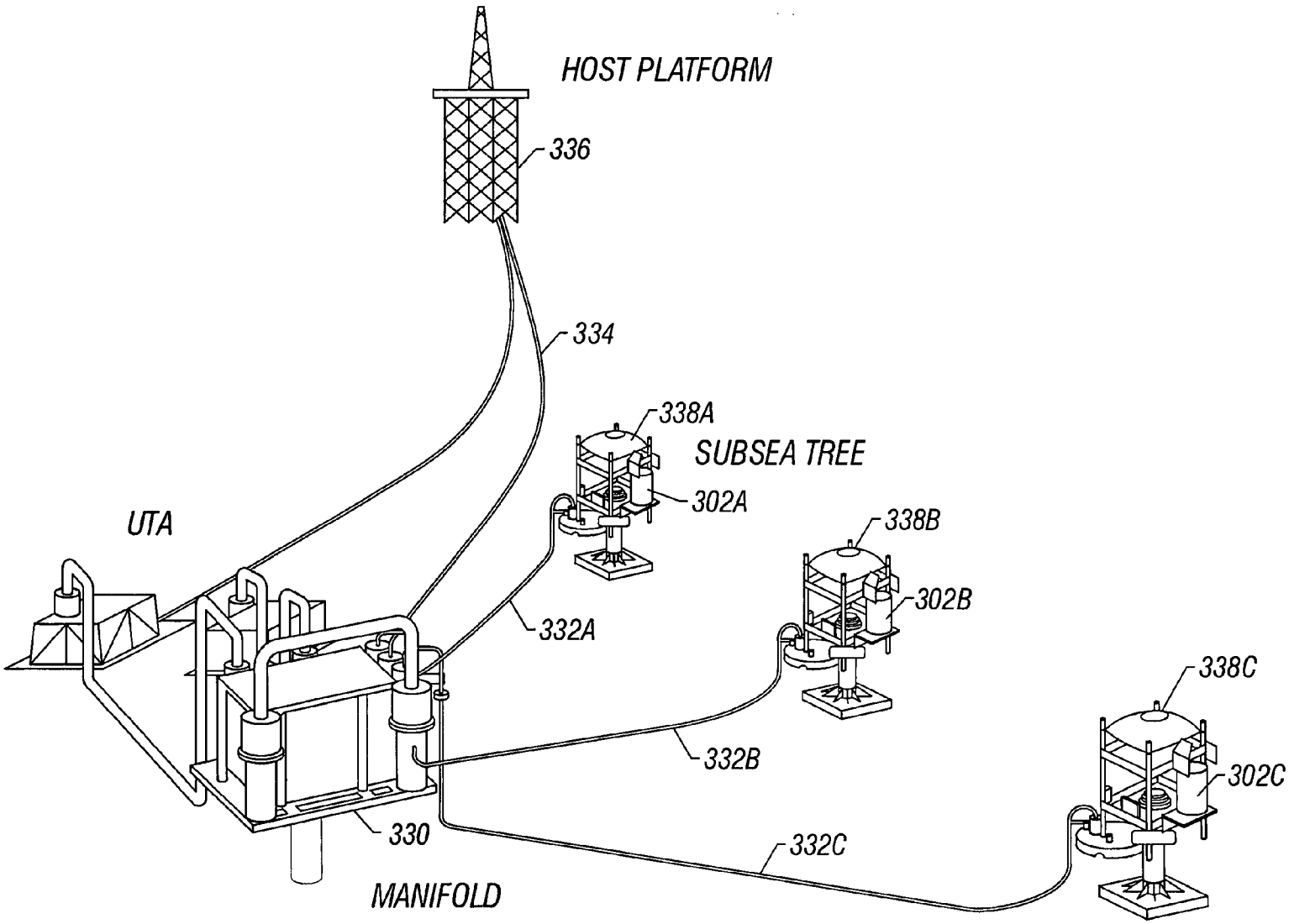
FIGS. 10-14 illustrate deployment of the intervention assembly of FIG. 9.

Deployment of the intervention assembly 300 is illustrated in FIGS. 10-14. FIG. 10 shows a plurality of subsea wellhead equipment 302A, 302B, and 302C, which are connected to a manifold 330 over respective flow lines 332A, 332B, and 332C. The manifold 330 is connected by another flow line 334 to a platform 336, which can be located on land or at the sea surface. As shown in FIG. 10, each of the subsea wellhead equipment 302A, 302B, and 302C are initially covered by a respective tree cap 338A, 338B, and 338C.

Figure 11:
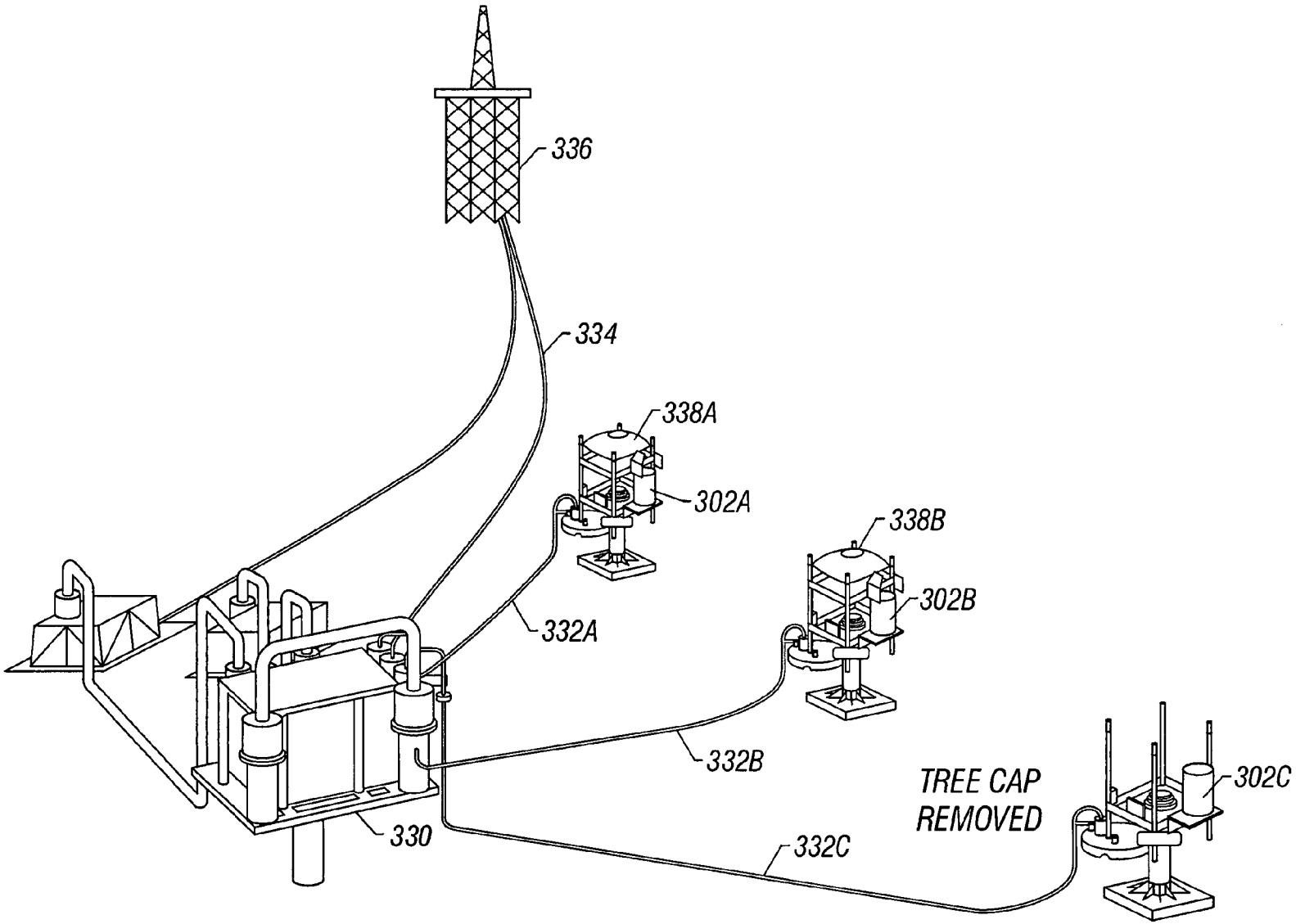
Figure 12:
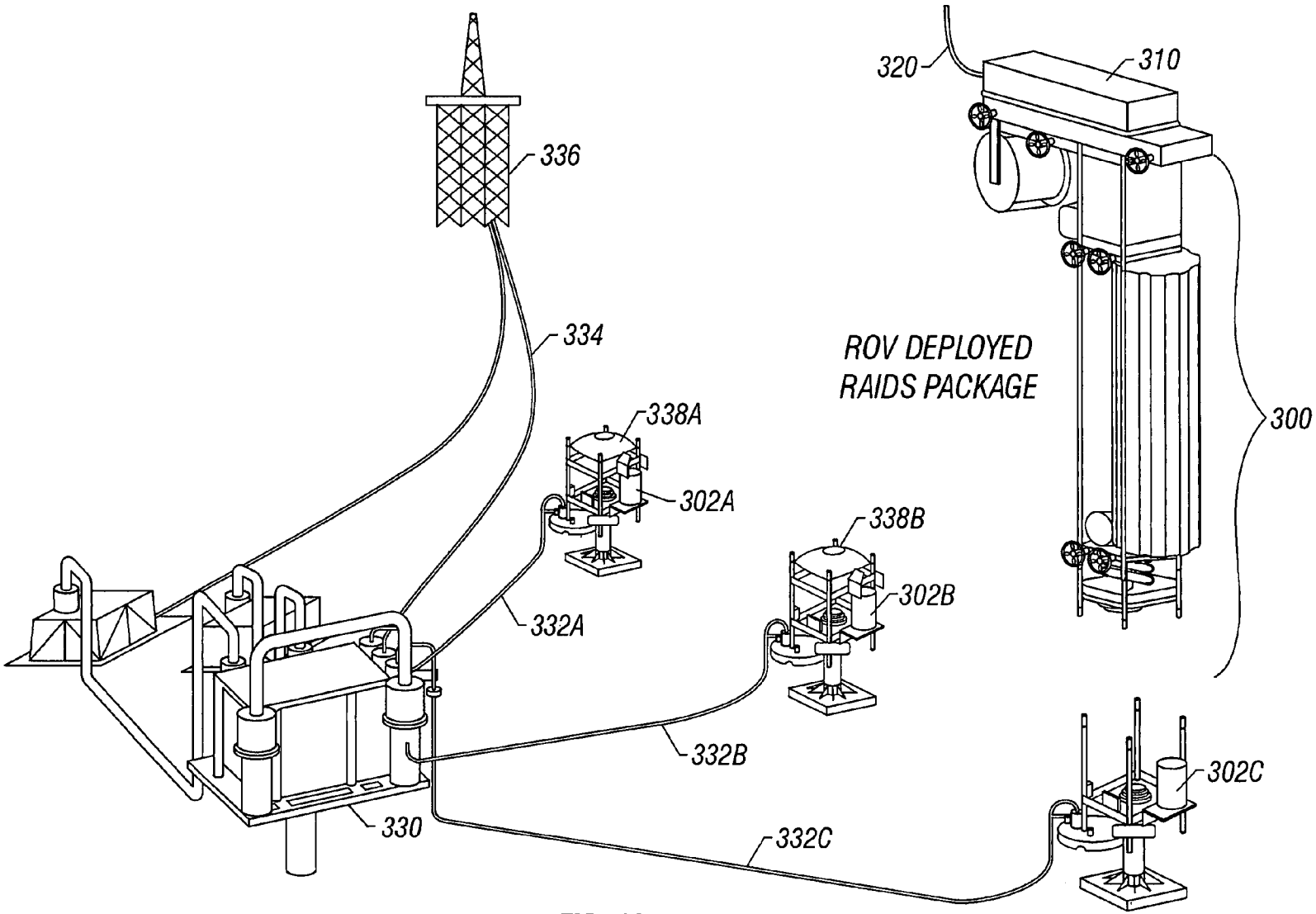

When intervention of the wellbore associated with the subsea wellhead equipment 302C is desired, the tree cap 338C is removed, as shown in FIG. 11. Removal of the tree cap can be accomplished by using an underwater marine unit. After the tree cap is removed, the intervention assembly 300 is carried by the underwater marine unit 310 to a region in the proximity of the subsea wellhead equipment 302C, as shown in FIG. 12. There, the underwater marine unit is controlled from a remote location to engage the assembly 300 with the subsea wellhead equipment 302C. Once engaged, as shown in FIG. 13, the intervention assembly 300 is ready for operation.

Figure 13:
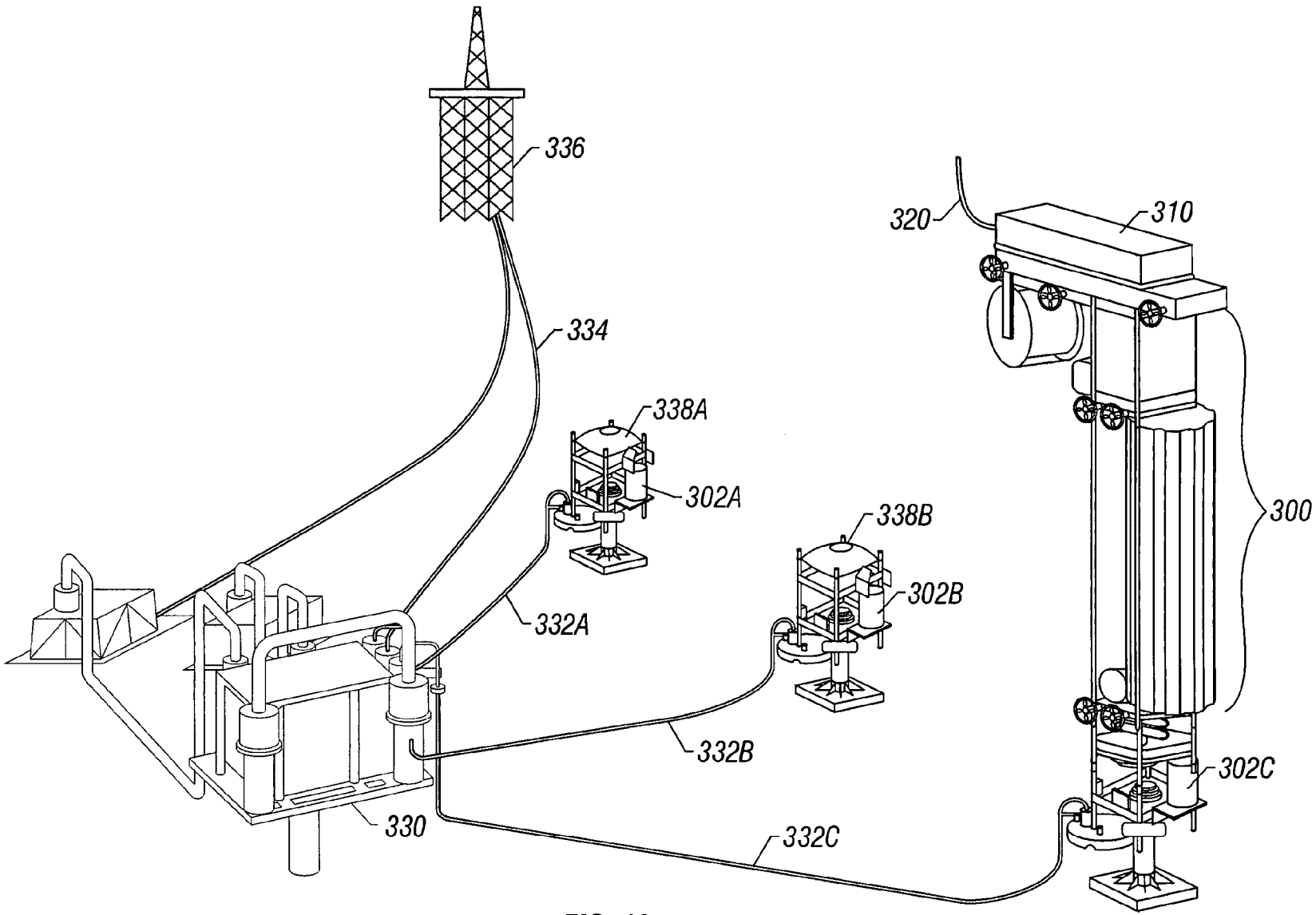
Figure 14:
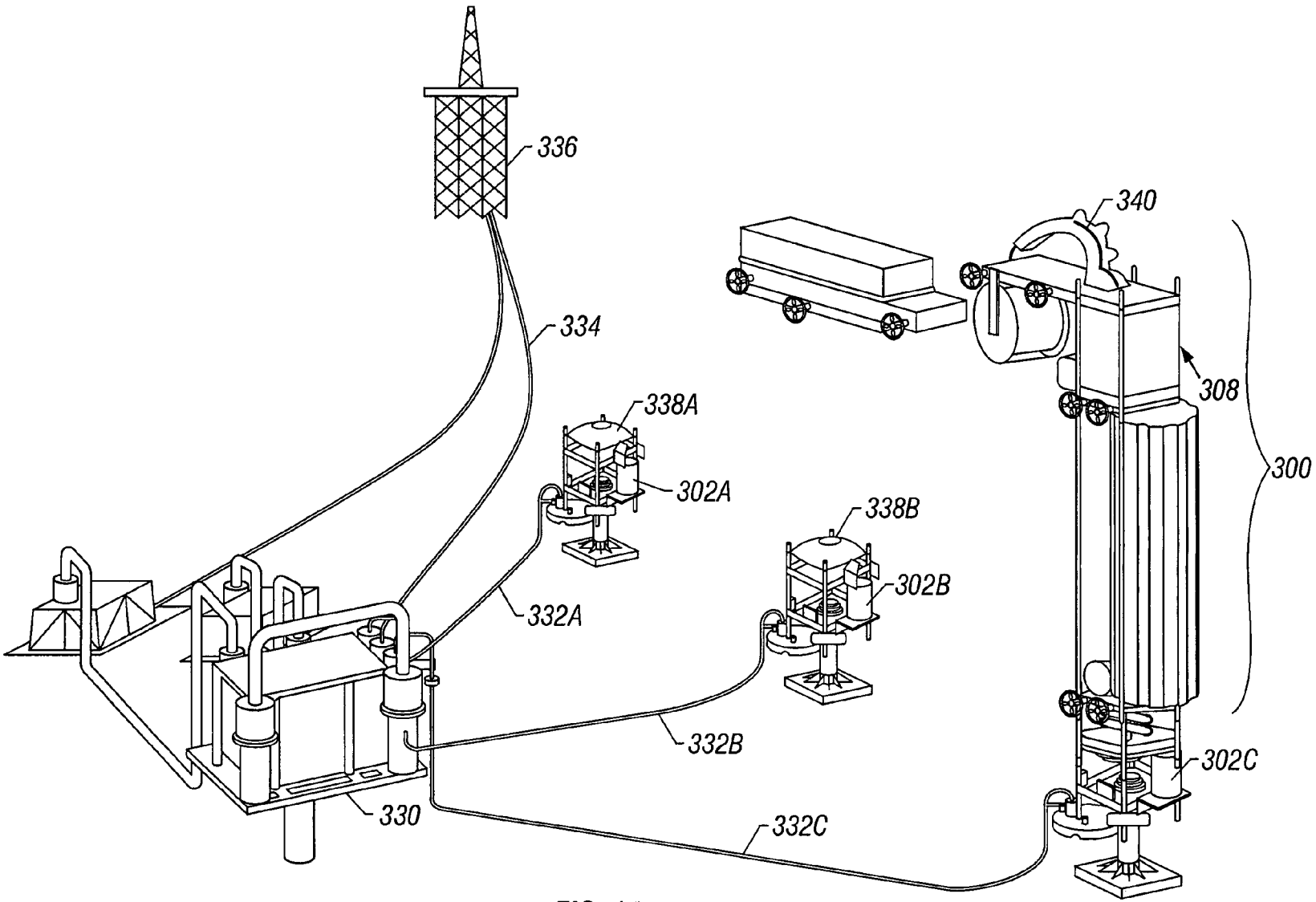

The intervention assembly 300 can be operated as shown in FIG. 13, where the underwater marine unit 310 remains attached to the carrier line spool assembly 308. Signaling is communicated over an umbilical line, in acoustic waves, by blue/green laser, or by some other mechanism to the underwater marine unit 310, which responds to the signaling by actuating the signal assembly 308. Alternatively, as shown in FIG. 14, the underwater marine unit 310 is detached from the spool assembly 308 once the assembly 300 is connected to the subsea wellhead equipment 302C. As further shown in FIG. 14, a gooseneck 340 allows the carrier line carried by the spool 314 to be guided into the injector head 316, where the carrier line is attached to one of the intervention tools of the carousel system 306.

Figure 15:
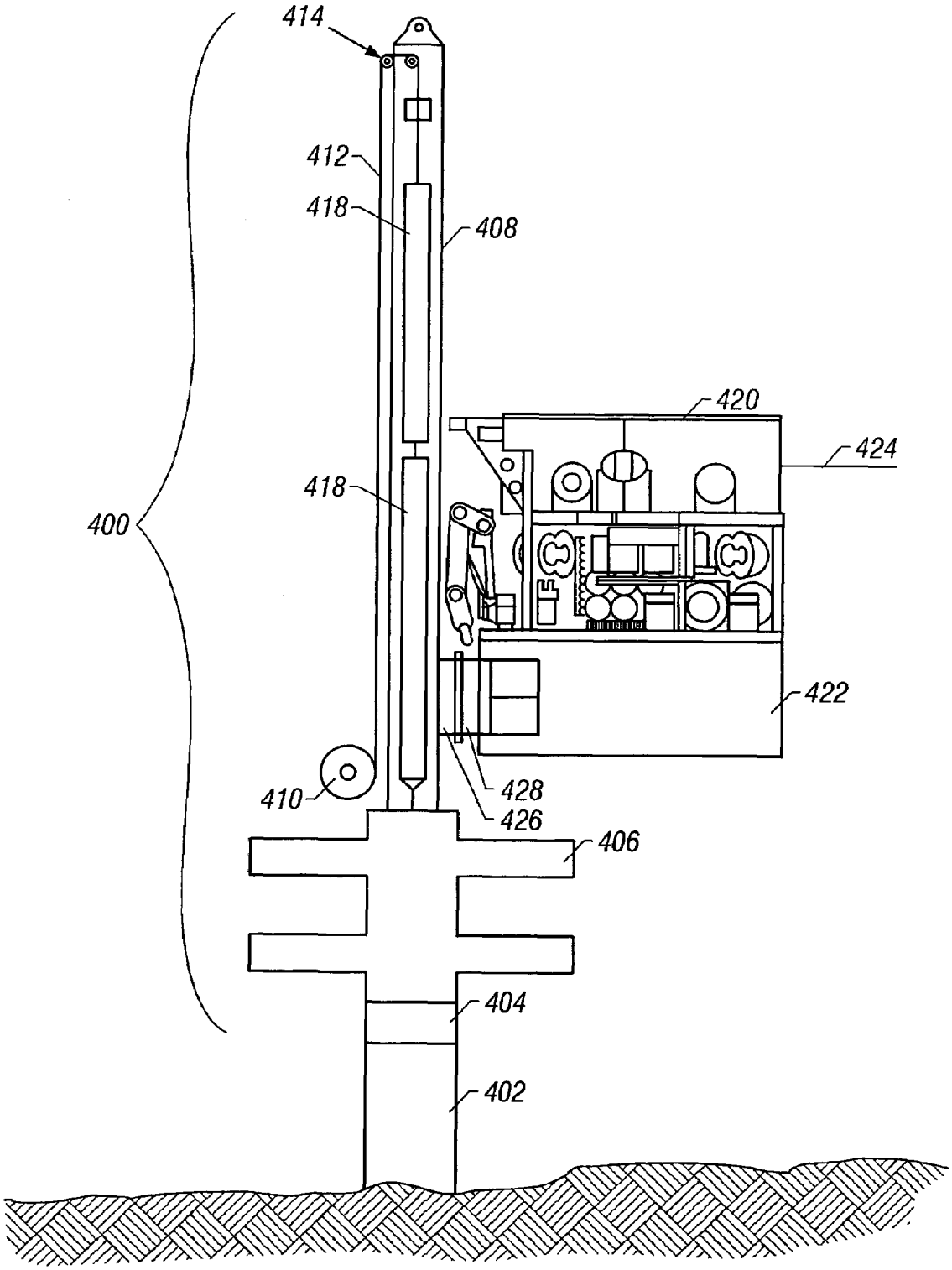
FIG. 15 illustrates yet another embodiment of an intervention assembly that uses either slickline or wireline.

Referring to FIG. 15, another embodiment of an intervention assembly 400 is illustrated. In the embodiment of FIG. 15, the carrier line used can either be a slickline or a wireline. The intervention assembly 400 includes a cap adapter 404 for attachment to subsea wellhead equipment 402. Attached above the cap adapter 404 is a BOP 406, which in turn is connected to a lower end of a lubricator 408. The lubricator 408 has a length that is sufficiently long to enable a tool string to be positioned within the lubricator 408. The intervention assembly 400 also includes a winch or spool 410 on which is mounted either a slickline or a wireline ("carrier line 412"). The carrier line 412 is extended from the winch 410 to upper sheaves 414, which direct the carrier line 412 into the lubricator 408. In the example shown in FIG. 15, the tool string in the lubricator 408 includes a tool 416 and weights 418, with the weights 418 used to help run the tool string into the wellbore beneath the subsea wellhead equipment 402.

In the example of FIG. 15, the winch 410 is driven by an underwater marine unit 420 that has a drive mechanism 422. When the underwater marine unit 420 is coupled to the intervention assembly 400, the drive mechanism 422 is operably engaged with the winch 410 to enable the drive mechanism 422 to rotate the winch 410 to either unwind or wind the carrier line 412. The underwater marine unit 420 is coupled by an umbilical line 424 to a remote entity. The remote entity is capable of sending commands to the underwater marine unit 420 to operate the winch 410.

In the embodiment shown in FIG. 15, the lubricator 408 has a port 426 that is capable of being engaged with a corresponding port 428 of the underwater marine unit 420. Thus, the underwater marine unit can be operated to dock the port 428 to the port 426. When the ports 426 and 428 are docked, the drive mechanism 422 is coupled to the winch 410 in one of three possible ways: electrically, mechanically, and/or hydraulically.

Figure 16:
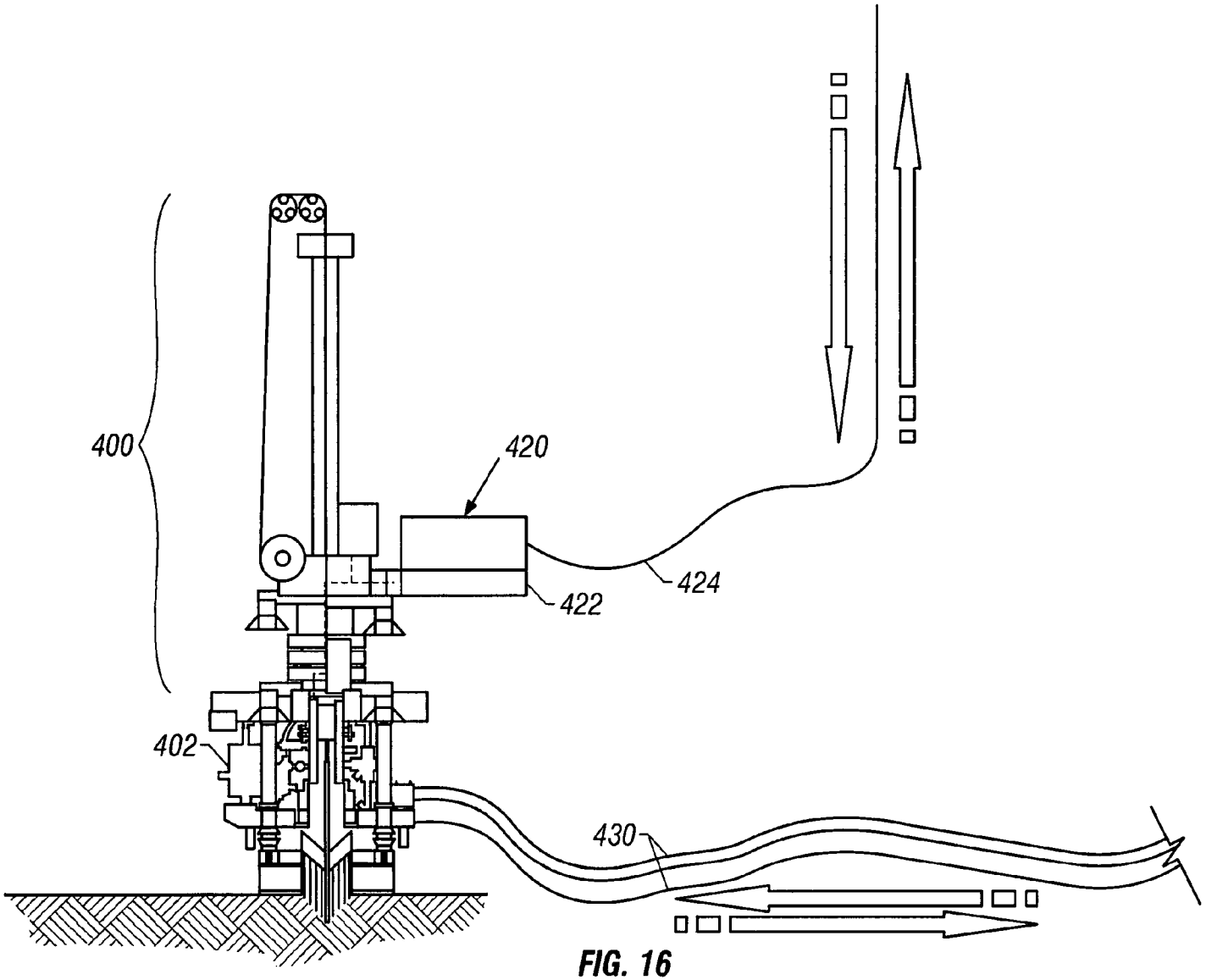
FIG. 16 illustrates a variation of the embodiment of FIG. 15.

Referring to FIG. 16, in accordance with an embodiment that is a variation of the FIG. 15 embodiment, the subsea wellhead equipment 402 is coupled by control lines 430 to a remote location. The control lines 430 are used to communicate electrical signals and/or hydraulic pressure. The electrical signals carried by the control lines 430 can provide power and commands to the intervention assembly 400. In the example of FIG. 16, the underwater marine unit 420 is also coupled by the umbilical line 424 to a remote entity.

Figure 17:
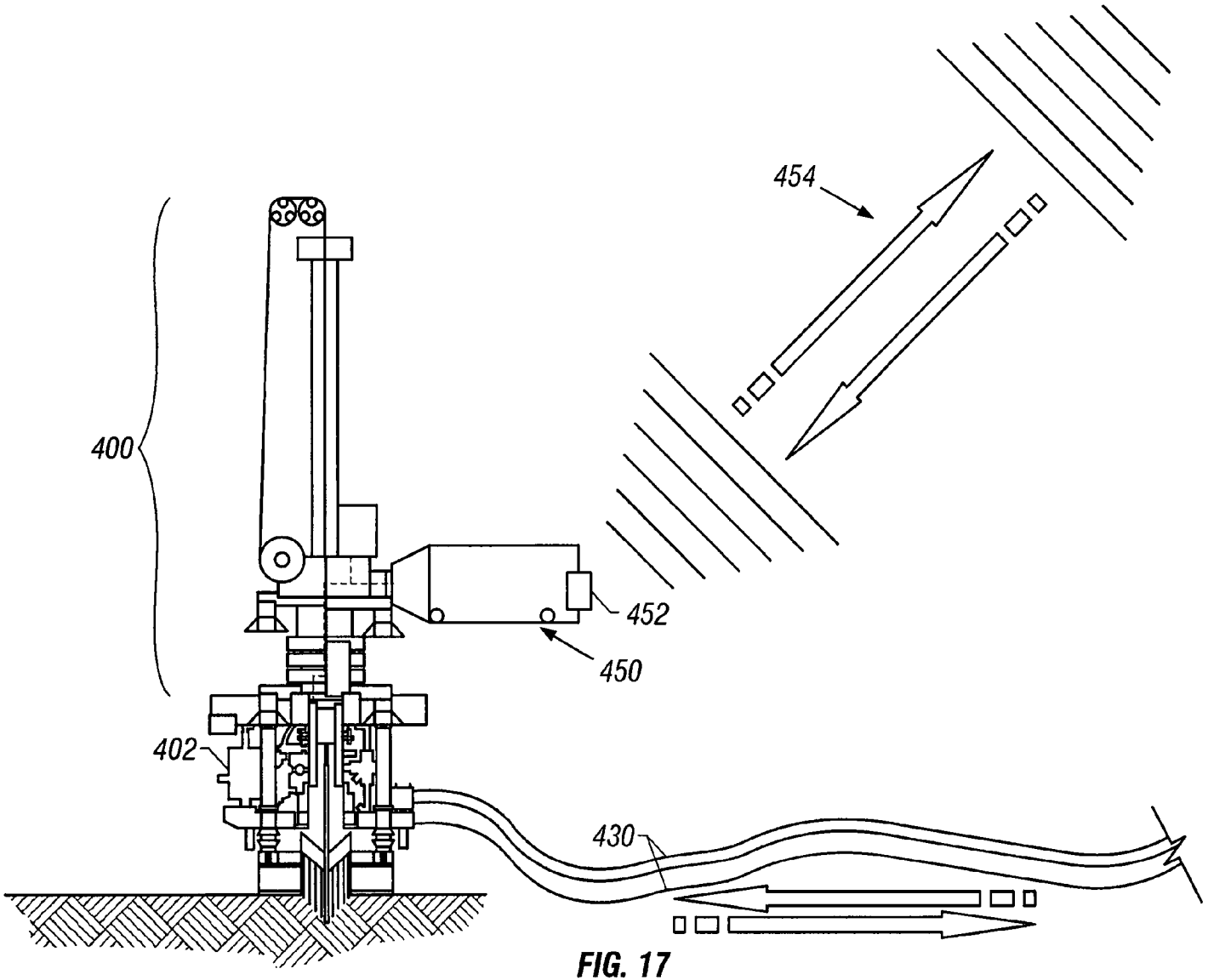
FIG. 17 illustrates another variation of the embodiment of FIG. 15.

In yet another variation, as shown in FIG. 17, the underwater marine unit 420 of FIG. 16 is replaced with another type of underwater marine unit 450, which is not coupled by an umbilical line to a remote entity. Instead, the underwater marine unit 450 includes a telemetry interface 452 that is capable of communicating wireless signals 454 with the remote entity. In one example, the wireless signals 454 are in the form of acoustic wave signals. Alternatively, the wireless signals can be in the form of blue/green lasers that carry signals to and from the underwater marine unit 450. Use of optics in an underwater environment is feasible with blue/green lasers, since they have relatively long wavelengths. The wireless underwater marine unit 450 can be used in the embodiment of FIG. 17 due to the presence of the control lines 430 that are coupled to the subsea wellhead equipment 402. In this configuration, power for the winch 410 can be provided over the control lines 430.

Figure 18:
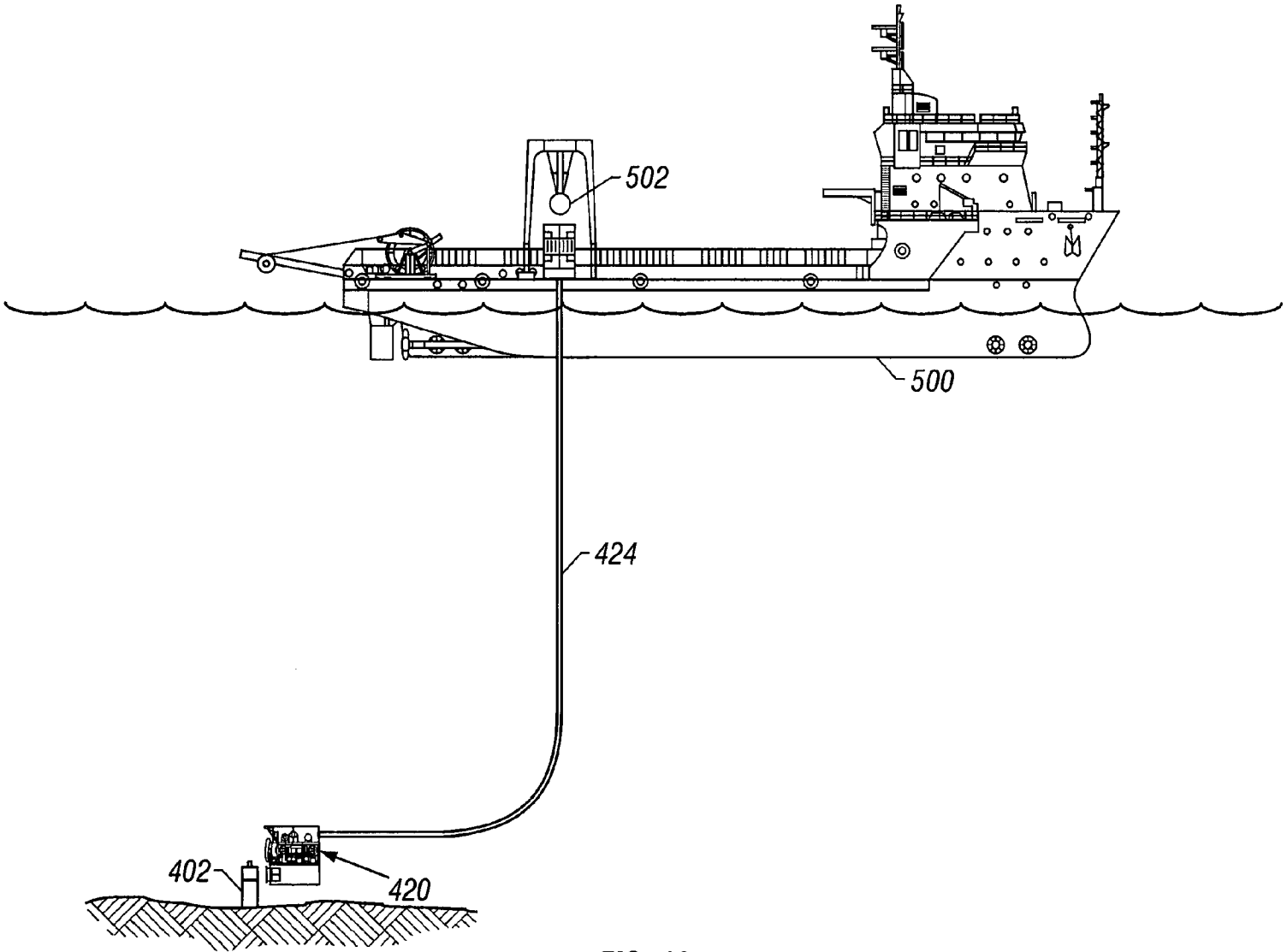
FIGS. 18-23 illustrate a deployment sequence of the embodiment of FIG. 15.
Figure 19:
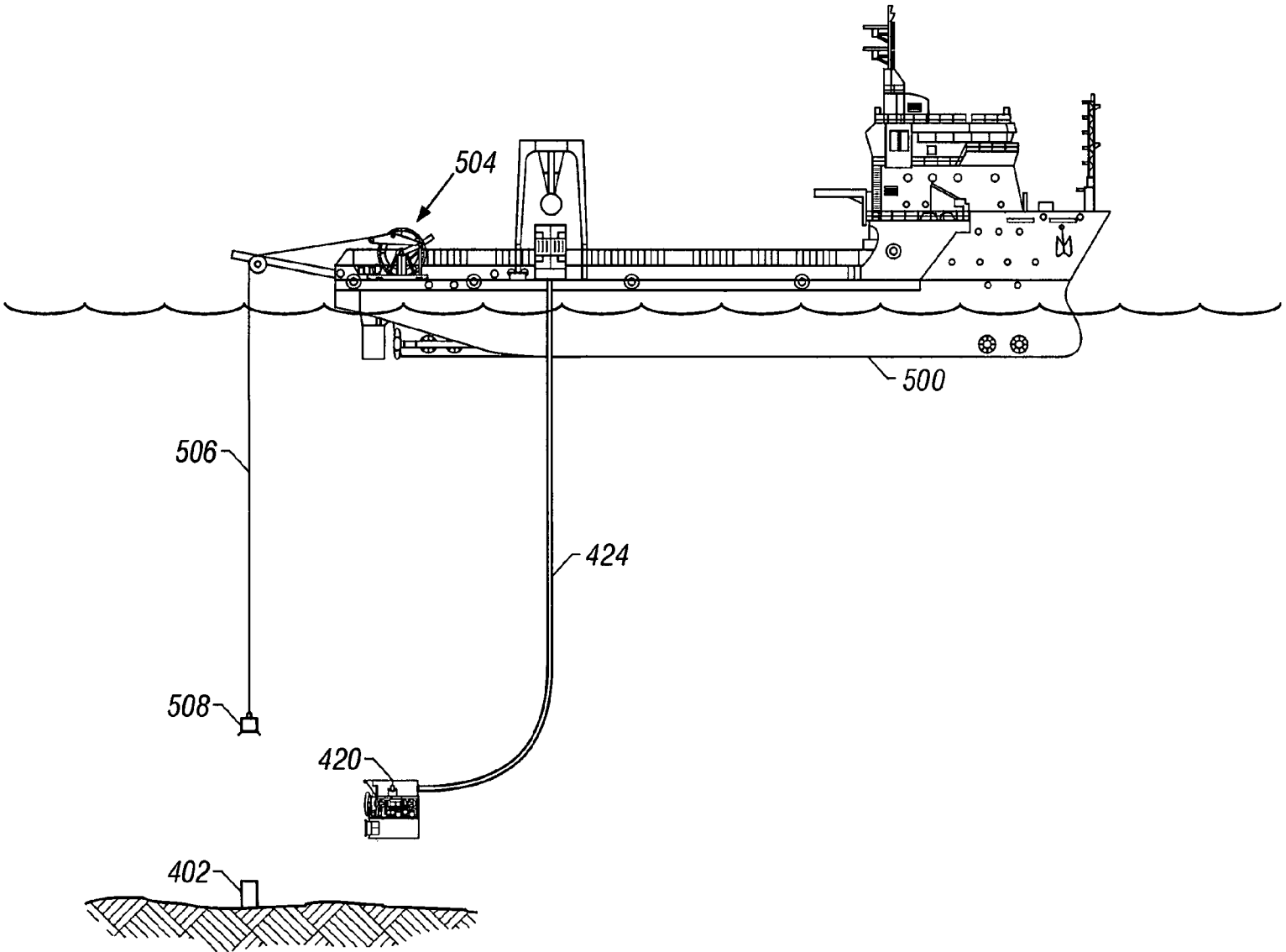

Referring to FIGS. 18-23, deployment of the subsea intervention assembly 400 of FIG. 15 according to one embodiment is illustrated. As shown in FIG. 18, a sea vessel 500 is brought to a location generally above the subsea wellhead equipment 402. The underwater marine unit 420 is then dropped from the sea vessel 500 into the sea, where it is driven to a region in the proximity of the subsea wellhead equipment 402. The umbilical line 424 connected to the underwater marine unit 420 is spooled from an umbilical line spool 502 that is located on the sea vessel 500. As shown in FIG. 19, the sea vessel 500 also includes a lift line spool assembly 504 that is used to deploy a lift line 506. The lift line 506 is lowered into the sea down to the subsea wellhead equipment. The underwater marine unit 420 is then operated to engage the lift line 506 to a cap 508 of the subsea wellhead equipment 402. The cap 508 is released from the subsea wellhead equipment 402, which may be performed by the underwater marine unit 420, and the lift line 506 is raised by the lift line spool 504 until the cap 508 is retrieved to the sea vessel 500.

Figure 20:
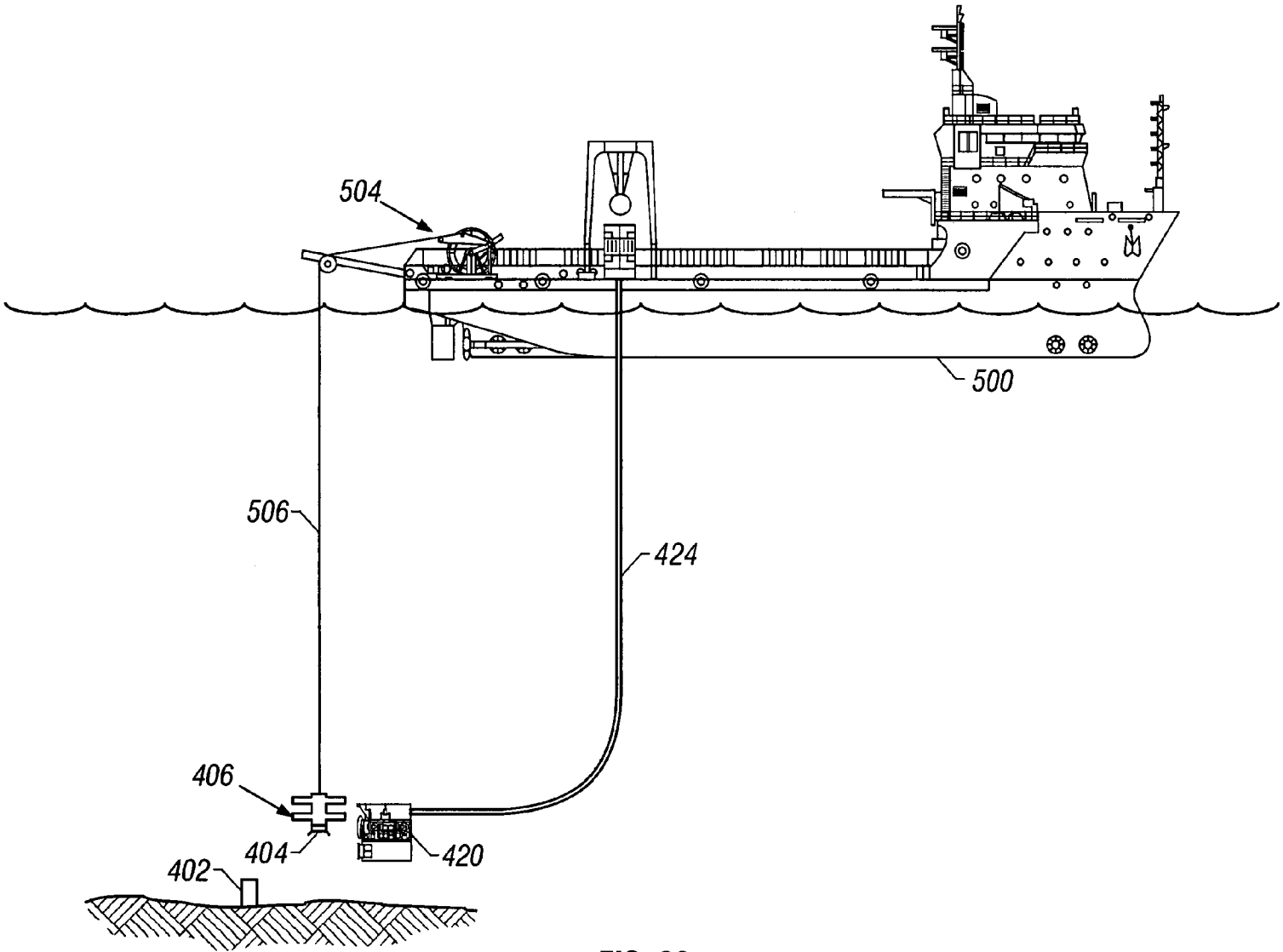

As shown in FIG. 20, the BOP 406 and attached cap adapter 404 are lowered by the lift line 506 from the sea vessel 500 into the sea to a region in close proximity to the subsea wellhead equipment 402. The underwater marine unit 420 then guides the cap adapter 404 into engagement with the subsea wellhead equipment 402 (with the tree cap 508 already removed). After performing a test of the engagement of the cap adapter 404 to the subsea wellhead equipment 402, the underwater marine unit 420 releases the lift line 506 from the BOP 406.

Figure 21:
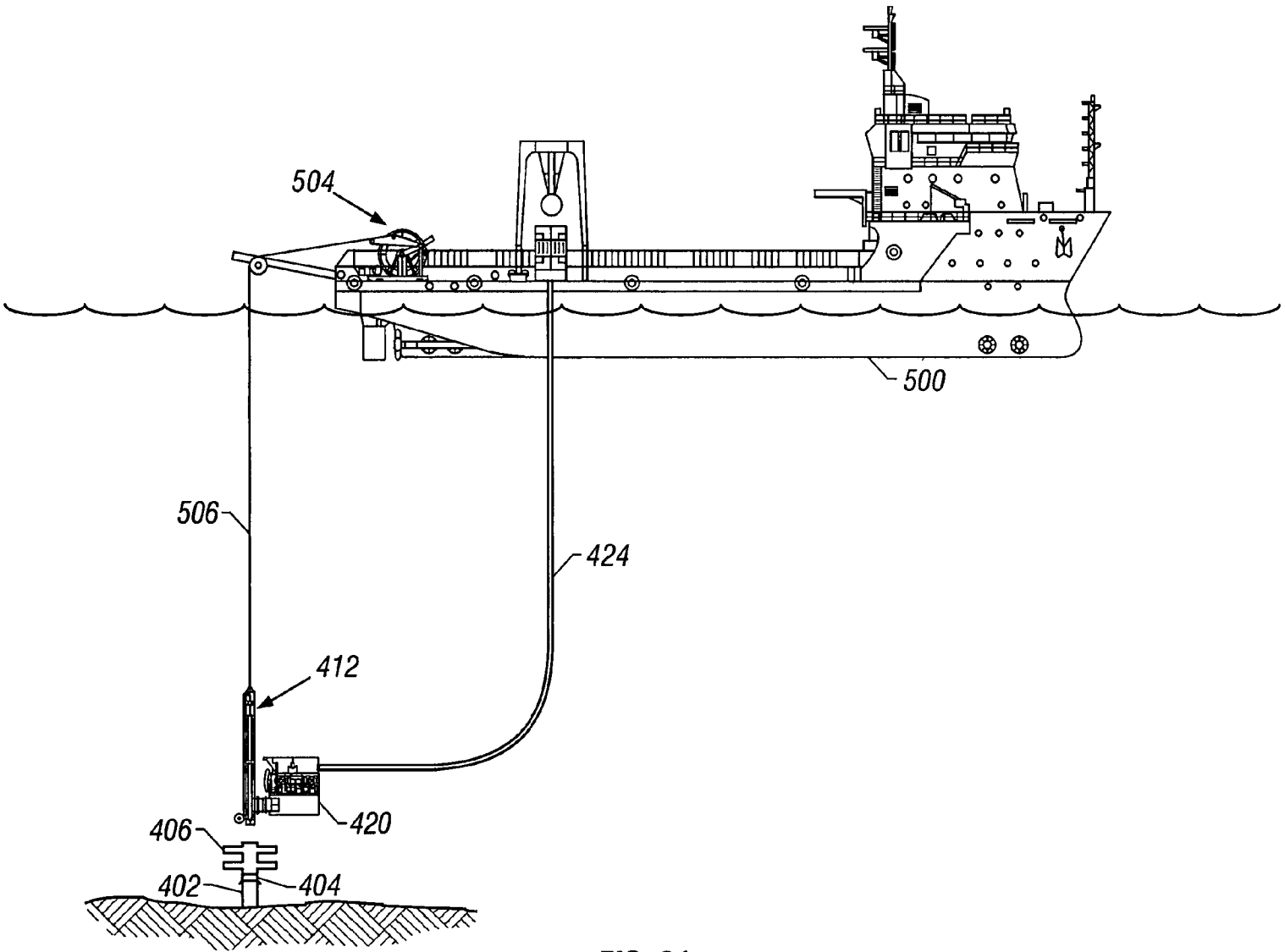

Next, as shown in FIG. 21, the lubricator 412 is attached to the lift line 506 and lowered into the sea until it reaches right above the BOP 406. The underwater marine unit 420 then attaches the lubricator 412 to the BOP 406. After a successful test, the underwater marine unit 420 detaches the lift line 506 from the lubricator 412.

Figure 22:
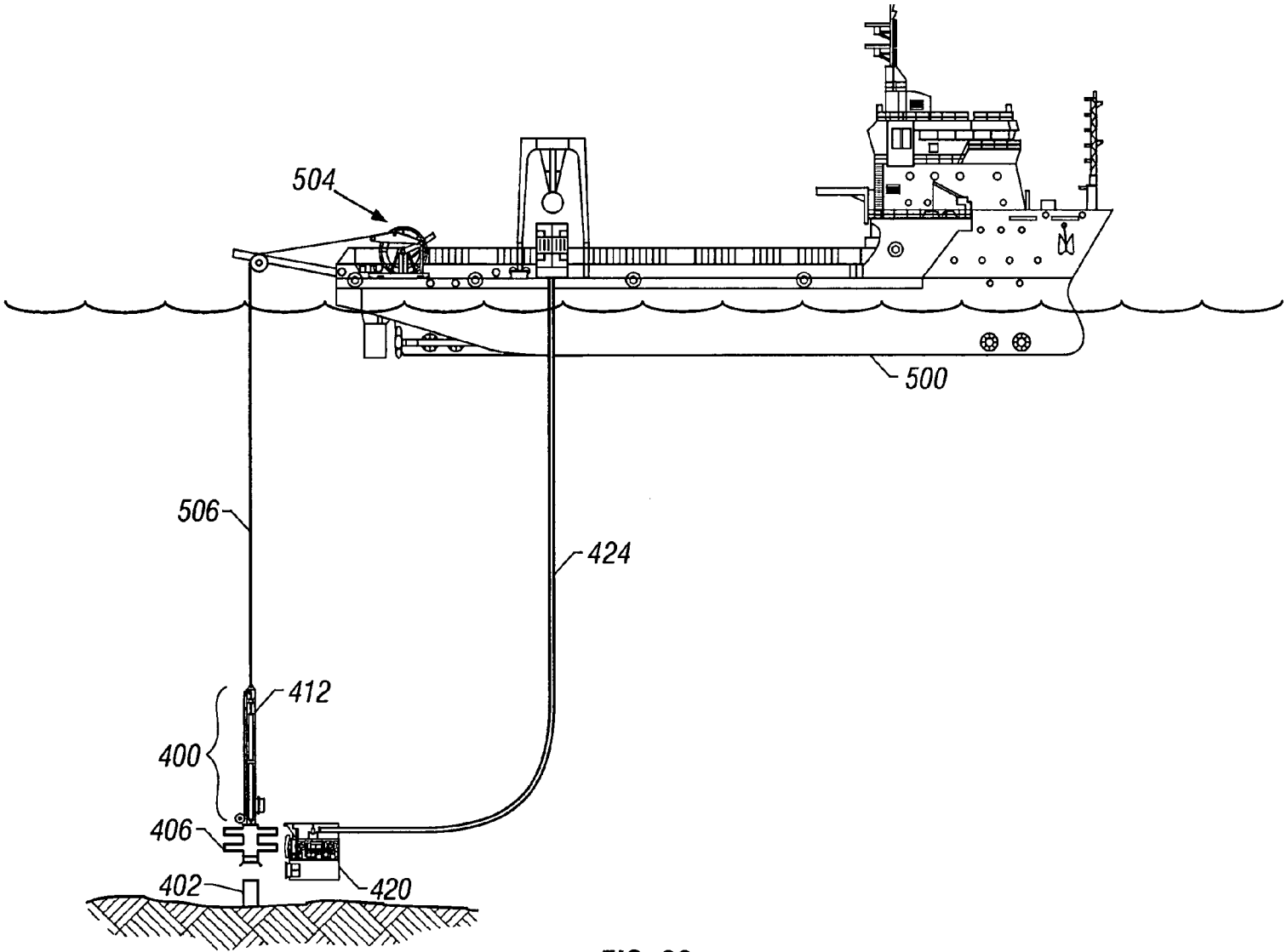

As shown in FIG. 22, in another embodiment, the lubricator 412, BOP 406, and cap adapter 404 can be lowered as an assembly on the lift line 506. Once the assembly 400 is in close proximity with the subsea wellhead equipment 402, the underwater marine unit 420 attaches the cap adapter 404 to the subsea wellhead equipment 402. This alternative embodiment is possible if the lift line assembly 504 is able to support the weight of the assembly 400. In some cases, the weight of the assembly 400 can be reduced by attaching buoyancy tanks to the assembly 400.

Figure 23:
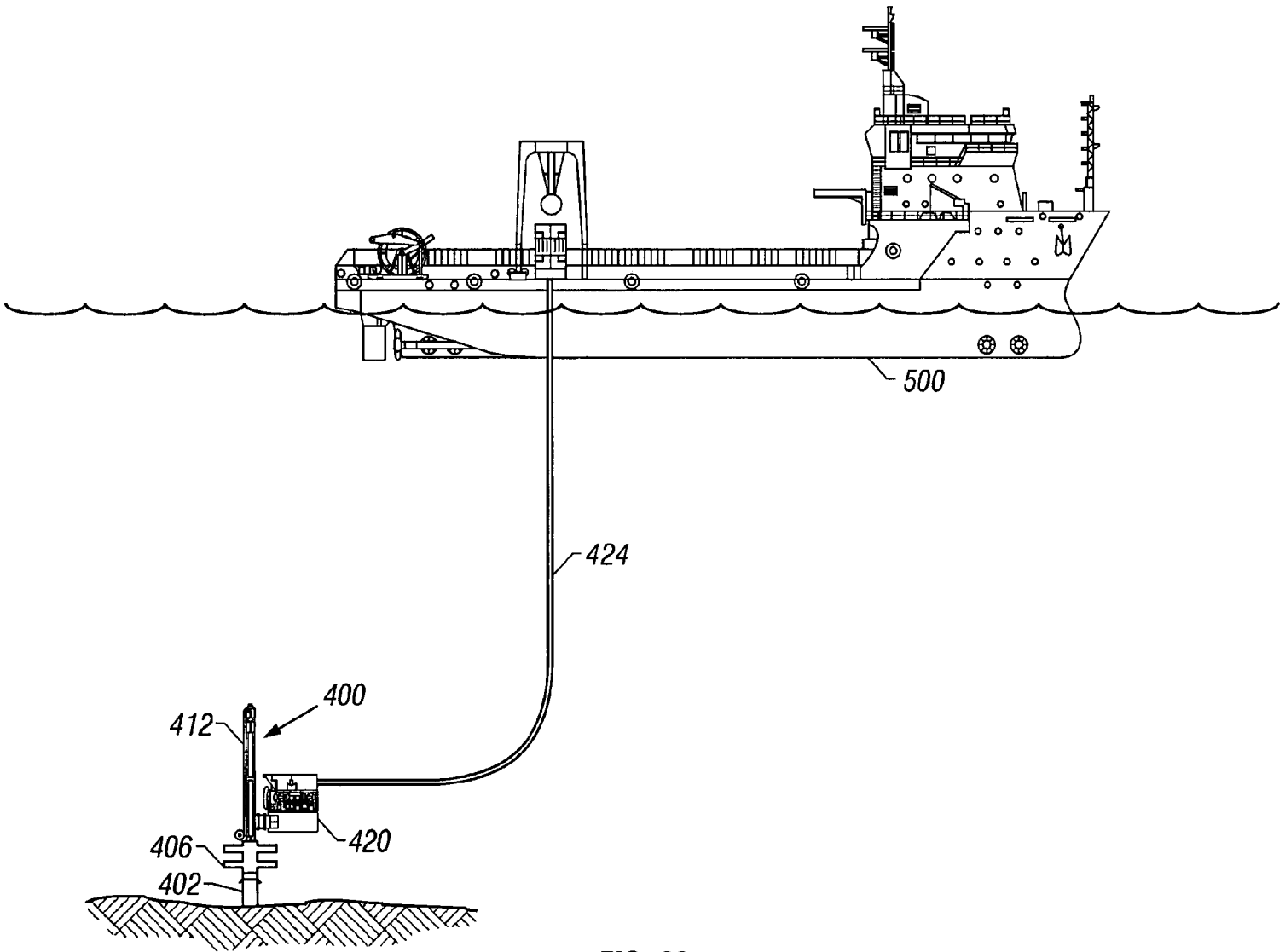

As shown in FIG. 23, once the assembly 400 is connected to the subsea wellhead equipment 402, the underwater marine unit 420 is docked to the port 426 of the lubricator 412. At this point, operation of the intervention assembly 400 can begin.

Figure 24:
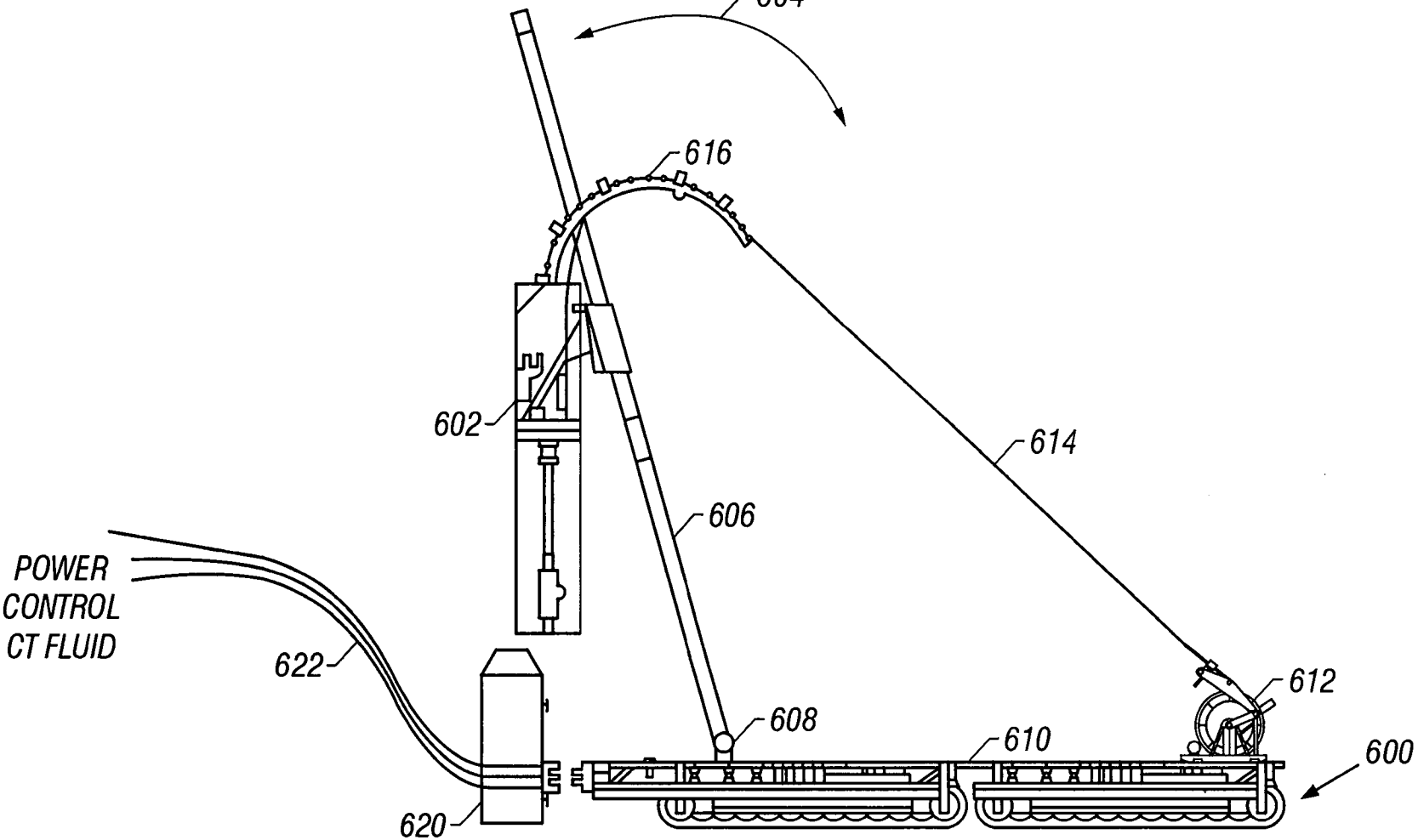
FIG. 24 illustrates a further embodiment of an intervention assembly that employs a subsea tractor capable of moving along a sea floor.

FIG. 24 shows yet another embodiment of an underwater marine unit 600 that is used to deploy an intervention assembly 602. In this embodiment, the underwater marine unit 600 is in the form of a subsea tractor that is capable of being driven along the sea bottom. The subsea tractor 600 includes a lift frame 606 that is pivotable about a pivot element 608. During transport, the lift frame 606 lies horizontally on the upper platform 610 of the subsea tractor 600.

The subsea tractor 600 also includes a carrier line spool 612 on which a carrier line 614 is mounted. The intervention assembly 602 includes a gooseneck 616 that is attached to the lift frame 606. The remainder of the intervention assembly 602 can also be attached to the lift frame 606.

In operation, the subsea tractor 600 is driven to a location near the subsea wellhead equipment 620. The subsea wellhead equipment 620 is connected by several control lines 622 to communicate power and control signaling and hydraulic pressure. The lift frame 606 is pivoted along an arcuate path 604 until it reaches an operational position, which is shown in FIG. 24. In this position, the intervention assembly 602 can be moved into engagement with the subsea wellhead equipment 620. Once engaged, the carrier line spool 612 can be operated to wind or unwind the carrier line so that an intervention tool can be lowered through the subsea wellhead equipment into a wellbore.

A convenient method and mechanism is thus provided to perform subsea intervention. By using underwater marine units inside the sea to connect intervention equipment to subsea wellhead equipment, relatively large sea vessels can be avoided since certain components, such as marine risers, can be omitted. Also, by positioning a carrier line spool at the sea floor or at some other location inside the sea, a carrier line can be more conveniently attached to the subsea wellhead. Convenient switching of intervention tools underwater is also possible by use of a carousel system that has plural chambers containing plural respective tools.

While the invention has been disclosed with respect to a limited number of embodiments, those skilled in the art will appreciate numerous modifications and variations therefrom. It is intended that the appended claims cover such modifications and variations as fall within the true spirit and scope of the invention.

The invention claimed is:

1. An apparatus for use with a subsea well, comprising:

a carrier line spool having a carrier line that is adapted to be positioned underwater; and a stack in a structure separate from the carrier line spool, the stack adapted to operatively couple to subsea wellhead equipment, and the carrier line attached to the stack, the stack having equipment to lower the carrier line into the subsea well.

2. The apparatus of claim 1, wherein the carrier line spool comprises a coiled tubing spool.

3. The apparatus of claim 1, wherein the carrier line spool is selected from the group consisting of a wireline spool and slickline spool.

4. The apparatus of claim 1, wherein the carrier line spool is adapted to be positioned on the sea floor separate from the stack.

5. The apparatus of claim 1, wherein the carrier line spool comprises a coiled tubing spool, wherein the equipment to lower the carrier line into the subsea well comprises an injector head adapted to drive coiled tubing from the coiled tubing spool.

6. The apparatus of claim 5, wherein the stack further comprises a gooseneck to provide support for coiled tubing reeled from the coiled tubing spool.

7. The apparatus of claim 5, further comprising at least one buoyancy tank attached to an assembly containing the injector head.

8. The apparatus of claim 1, further comprising a carousel containing a plurality of intervention tools, the intervention tools engageable by the carrier line.

9. The apparatus of claim 8, wherein the carousel is rotatable underwater to enable switching of tools for connection to the carrier line.

10. The apparatus of claim 1, wherein the stack contains an emergency disconnect package.

11. The apparatus of claim 10, further comprising a connector connected between the emergency disconnect package and the subsea wellhead equipment.

12. The apparatus of claim 1, further comprising an underwater marine unit to attach intervention equipment separate from the carrier line to the subsea wellhead equipment, the intervention equipment comprising the stack.

13. The apparatus of claim 12, wherein the stack comprises a frame.

14. A method of intervention with a subsea well, comprising:

positioning a carrier line spool underwater;

attaching a stack to subsea wellhead equipment, the stack in a structure separately located from the carrier line spool;

deploying a carrier line of the carrier line spool into the stack; and lowering the carrier line into the subsea well.

15. The method of claim 14, wherein deploying the carrier line comprises deploying the carrier line through an injector head in the stack.

16. The method of claim 15, wherein deploying the carrier line comprises deploying the carrier line through a gooseneck to the injector head.

17. The method of claim 14, wherein the carrier line is lowered into the subsea well to perform an intervention operation.

18. The method of claim 17, further comprising raising the carrier line after the intervention operation is completed and switching tools connected to the carrier line.

19. The method of claim 18, wherein switching tools comprises actuating a carousel system having chambers containing a plurality of tools.

20. The method of claim 19, further comprising engaging the carrier line with another tool after actuating the carousel system.

21. The method of claim 14, further comprising using an underwater marine unit to deploy the carrier line into the stack.

22. The method of claim 14, further comprising lowering, using an underwater marine unit, the carrier line spool to a position on a sea floor.

23. The method of claim 22, further comprising attaching buoyancy tanks to the carrier line spool to enable the underwater marine unit to carry the carrier line spool underwater.

24. A method of intervention with a subsea well, comprising:

positioning a carrier line spool underwater;

attaching a stack to subsea wellhead equipment, the stack in a structure separately located from the carrier line spool;

coupling a carrier line of the carrier line spool to the stack;

attaching intervention equipment separate from the carrier line to the subsea wellhead equipment; and lowering the carrier line into the subsea well using the intervention equipment.

25. The method of claim 24, wherein the intervention equipment includes the stack.

* * * * *